US009317005B2

(12) United States Patent
Monde et al.

(10) Patent No.: US 9,317,005 B2
(45) Date of Patent: Apr. 19, 2016

(54) IMAGE FORMING APPARATUS FOR DETERMINING REMAINING AMOUNT OF DEVELOPER IN DEVELOPER CONTAINER

(75) Inventors: Masafumi Monde, Yokohama (JP); Toshikazu Tsuchiya, Susono (JP); Hidetoshi Hanamoto, Mishima (JP); Tsutomu Ishida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/112,801

(22) PCT Filed: Apr. 19, 2012

(86) PCT No.: PCT/JP2012/061157

§ 371 (c)(1),
(2), (4) Date: Oct. 18, 2013

(87) PCT Pub. No.: WO2012/147826

PCT Pub. Date: Nov. 1, 2012

(65) Prior Publication Data

US 2014/0037305 A1 Feb. 6, 2014

(30) Foreign Application Priority Data

Apr. 26, 2011 (JP) ..... 2011-098088
May 12, 2011 (JP) ..... 2011-107370
Jun. 7, 2011 (JP) ..... 2011-127421

(51) Int. Cl.
*G03G 15/08* (2006.01)
*G03G 21/16* (2006.01)

(52) U.S. Cl.
CPC ..... *G03G 21/1652* (2013.01); *G03G 15/086* (2013.01)

(58) Field of Classification Search
CPC ..... G03G 21/1652; G03G 15/086
USPC ..... 399/27, 30
See application file for complete search history.

(56) References Cited

U.S. PATENT DOCUMENTS 6,064,842 A 5/2000 Takeuchi et al.
6,208,816 B1 3/2001 Koizumi et al.

(Continued)

FOREIGN PATENT DOCUMENTS

EP 1 083 464 A2 3/2001
JP 54-48250 A 4/1979

(Continued)

OTHER PUBLICATIONS

JP2004-354904, Kimura et al., Machine English Translations.*

(Continued)

*Primary Examiner* — Susan Lee
(74) *Attorney, Agent, or Firm* — Fitzpatrick, Cella, Harper & Scinto

(57) ABSTRACT

An image forming apparatus includes a developing unit that contains developer and that is detachable; and a detection member that includes a detected electrode and that moves around a rotation shaft in the developing unit, an electrostatic capacitance sensor electrode that is provided on an outer side of the developing unit, an electrostatic capacitance sensor that detects an electrostatic capacitance between the detected electrode and the electrostatic capacitance sensor electrode and that outputs data related to the detected electrostatic capacitance, and a CPU that determines an amount of the developer in the developing unit based on the data output from the electrostatic capacitance sensor.

8 Claims, 27 Drawing Sheets

(56) References Cited

U.S. PATENT DOCUMENTS

| | | | | |
|---|---|---|---|---|
| 8,971,734 | B2 * | 3/2015 | Tsuchiya et al. | 399/27 |
| 2002/0037173 | A1 | 3/2002 | Kakeshita | |
| 2009/0010659 | A1 * | 1/2009 | Watanabe | 399/27 |
| 2013/0308965 | A1 | 11/2013 | Tsuchiya et al. | |
| 2014/0023385 | A1 | 1/2014 | Hosoya et al. | |

FOREIGN PATENT DOCUMENTS

| | | | |
|---|---|---|---|
| JP | 63-118173 | A | 5/1988 |
| JP | 2-68580 | A | 3/1990 |
| JP | 02-197881 | A | 8/1990 |
| JP | 4-98272 | A | 3/1992 |
| JP | 6-110331 | A | 4/1994 |
| JP | 9-127779 | A | 5/1997 |
| JP | 09-265234 | A | 10/1997 |
| JP | 11-84850 | A | 3/1999 |
| JP | 11-142220 | A | 5/1999 |
| JP | 2000-147891 | A | 5/2000 |
| JP | 2001-117441 | A | 4/2001 |
| JP | 2002-132036 | A | 5/2002 |
| JP | 2004-354904 | A | 12/2004 |
| JP | 2006-71780 | A | 3/2006 |
| JP | 4137703 | B2 | 8/2008 |

OTHER PUBLICATIONS

International Preliminary Report on Patentability mailed Nov. 7, 2013, in International Application No. PCT/JP2012/061157.

Office Action issued in Japanese Patent Application No. 2011-098088, dated Feb. 24, 2015.

International Search Report and Written Opinion mailed Sep. 27, 2012, in International Application No. PCT/JP2012/061157.

Office Action issued in Japanese Patent Application No. 2011-098088, dated Oct. 6, 2015.

* cited by examiner

FIG. 5A
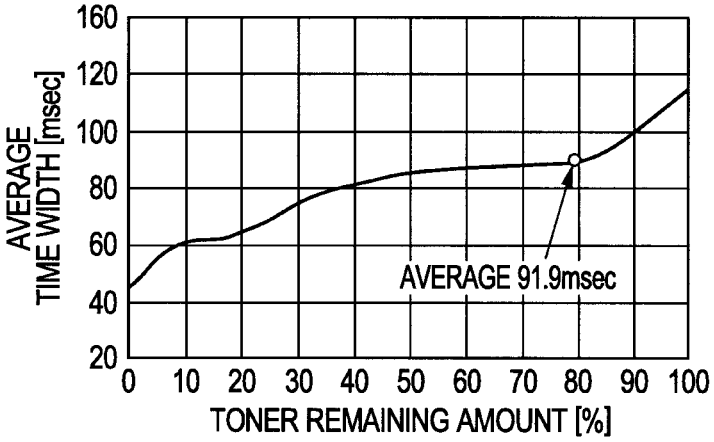
FIG. 5B
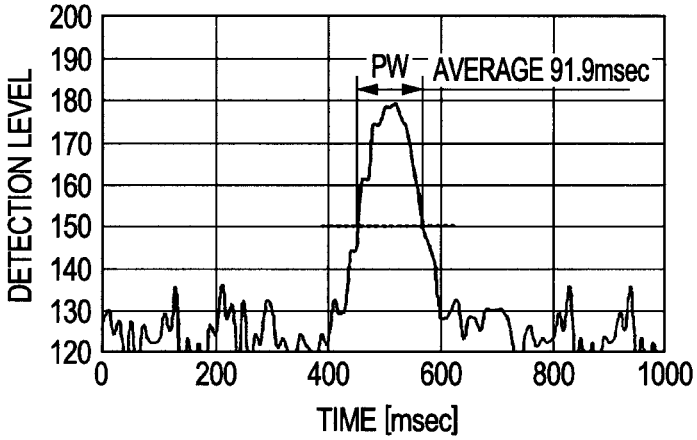
FIG. 5C
| TABLE T | |
|---|---|
| AVERAGE TIME WIDTH [msec] | TONER REMAINING AMOUNT [%] |
| 113.6 | 100 |
| 101.8 | 90 |
| 91.9 | 80 |
| 88.8 | 70 |
| 86.3 | 60 |
| 83.9 | 50 |
| 81.5 | 40 |
| 75.8 | 30 |
| 68.7 | 20 |
| 58.9 | 10 |
| 45.5 | 0 |

| FIG. 6A |
| --- |
| FIG. 6B |

FIG. 8A
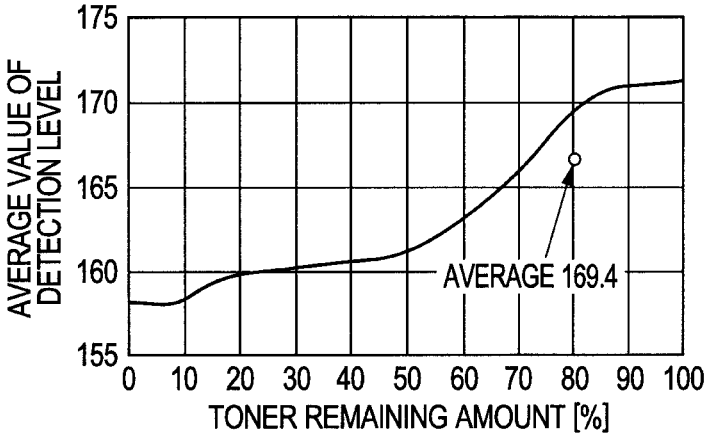
FIG. 8B
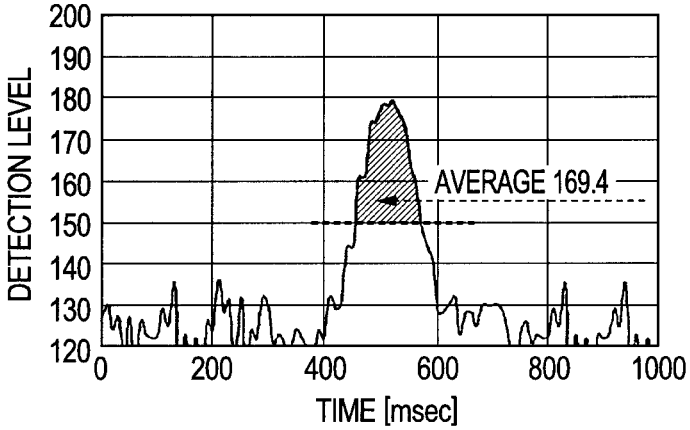
FIG. 8C
| TABLE L | |
|---|---|
| AVERAGE VALUE OF DETECTION LEVEL | TONER REMAINING AMOUNT (%) |
| 172.2 | 100 |
| 171.3 | 90 |
| 169.4 | 80 |
| 165.9 | 70 |
| 163.3 | 60 |
| 161.2 | 50 |
| 160.5 | 40 |
| 160.3 | 30 |
| 159.8 | 20 |
| 157.4 | 10 |
| 156.1 | 0 |

| FIG. 9A |
| --- |
| FIG. 9B |

FIG. 14A
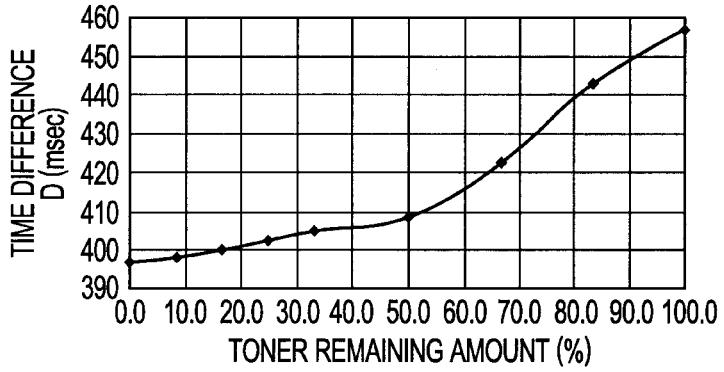
FIG. 14B
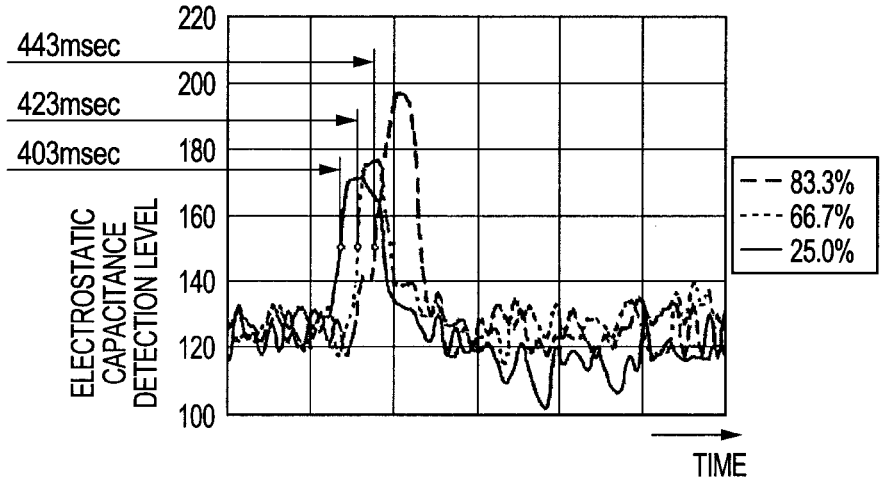
FIG. 14C
TABLE T
| TIME DIFFERENCE (msec) | TONER REMAINING AMOUNT (%) |
|---|---|
| 457 | 100.0 |
| 443 | 83.3 |
| 423 | 66.7 |
| 409 | 50.0 |
| 405 | 33.3 |
| 403 | 25.0 |
| 400 | 16.7 |
| 398 | 8.3 |
| 397 | 0.0 |

| FIG. 15A |
| --- |
| FIG. 15B |

FIG. 19A
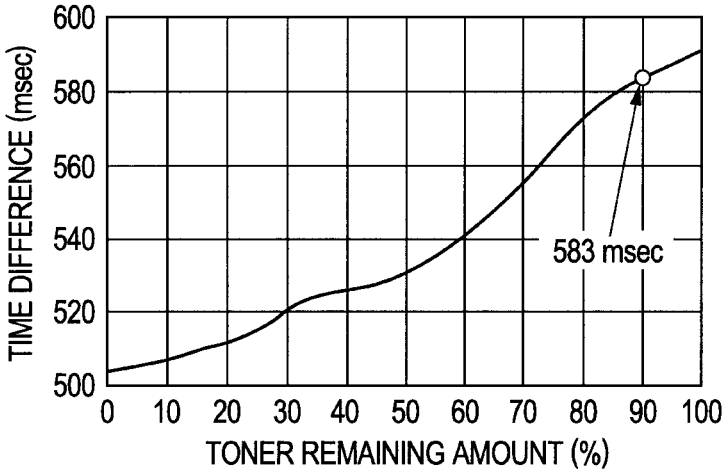
FIG. 19B
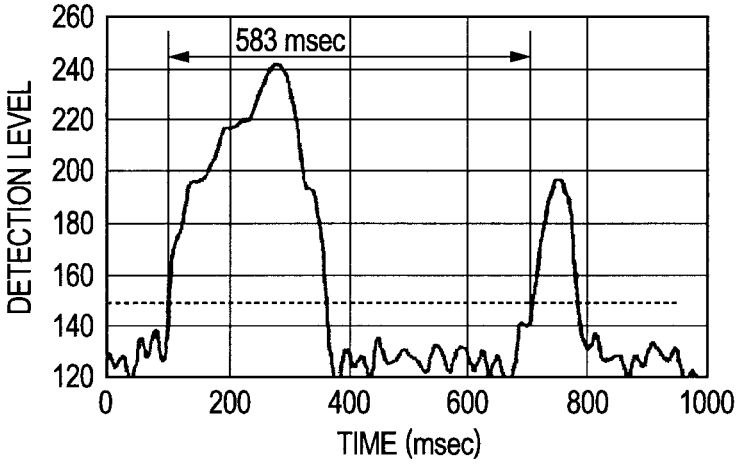
FIG. 19C
TABLE T
| TIME DIFFERENCE (msec) | TONER REMAINING AMOUNT (%) |
|---|---|
| 591 | 100 |
| 583 | 90 |
| 573 | 80 |
| 555 | 70 |
| 542 | 60 |
| 530 | 50 |
| 527 | 40 |
| 521 | 30 |
| 513 | 20 |
| 508 | 10 |
| 504 | 0 |

FIG. 21A
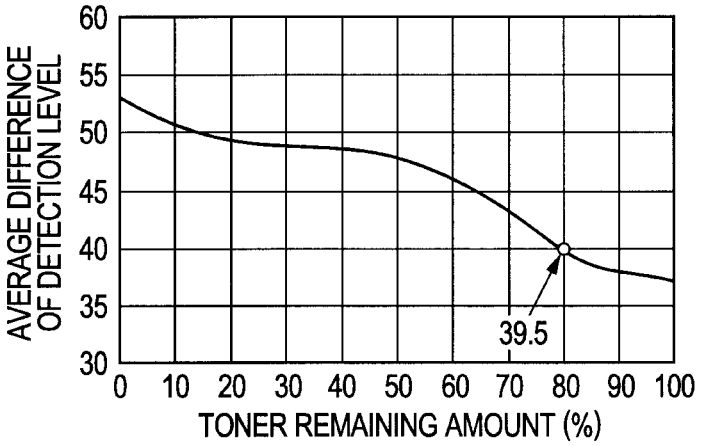
FIG. 21B
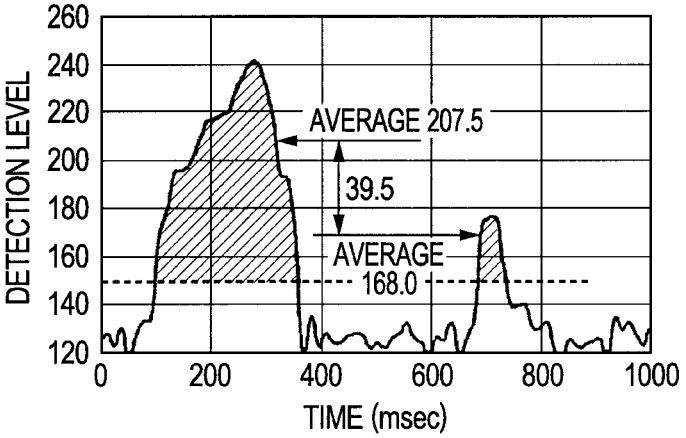
FIG. 21C
TABLE L
| AVERAGE DIFFERENCE OF DETECTION LEVEL | TONER REMAINING AMOUNT (%) |
|---|---|
| 37.0 | 100 |
| 38.0 | 90 |
| 39.5 | 80 |
| 43.0 | 70 |
| 46.0 | 60 |
| 48.0 | 50 |
| 48.5 | 40 |
| 49.0 | 30 |
| 49.5 | 20 |
| 50.5 | 10 |
| 53.0 | 0 |

| FIG. 22A |
| --- |
| FIG. 22B |

IMAGE FORMING APPARATUS FOR DETERMINING REMAINING AMOUNT OF DEVELOPER IN DEVELOPER CONTAINER

TECHNICAL FIELD

The present invention relates to remaining amount detection of a toner that is a developer in an electrophotographic image forming apparatus such as a laser printer, a copy machine, and a facsimile.

BACKGROUND ART

There is an example of a conventional image forming apparatus in which an electrostatic capacitance detection apparatus detects a remaining amount of a toner in a toner container. For example, in a toner remaining amount detection apparatus described in PTL 1, a flexible member is coupled and fixed at one edge of an agitation member that agitates a toner in a toner container. A subject is fixed at a leading edge of the flexible member, and an electrostatic capacitance detection apparatus is provided at a lower part of the toner container. The flexible member coupled to the agitation member also rotates following the rotation of the agitation member and enters the toner. If the toner surface in the toner container is higher than the position where the flexible member and the agitation member are coupled, the flexible member enters the toner at the section coupled with the agitation member. The entire flexible member is flexibly transformed, and the flexible member rotates and moves at the same orbit (trajectory) as the coupled section in the toner. Therefore, the subject at the leading edge of the flexible member also rotates and moves at the same orbit as the flexible member. However, if the amount of the toner is reduced and the coupled section of the agitation member does not enter the toner when the toner surface is lower than the coupled position of the flexible member and the agitation member, the neighborhood of the leading edge of the flexible member slides over the toner surface, and the subject also slides and moves over the toner surface. If the remaining amount of the toner gradually decreases, the height of the toner surface in the toner container is also gradually reduced along with the decrease. The position of the subject that slides and moves over the toner surface is also gradually reduced. Therefore, if the toner decreases to less than a certain amount, the position of the subject that moves over the toner surface is also reduced according to the remaining amount of the toner, and the subject approaches the bottom of the toner container.

Meanwhile, the electrostatic capacitance detection apparatus can detect an electrostatic capacitance between the electrostatic capacitance detection apparatus and the subject that moves over the toner surface. The electrostatic capacitance between the electrostatic capacitance detection apparatus and the subject changes according to the distance between the two. The electrostatic capacitance detection apparatus is provided at a lower part of the toner container. Therefore, if the amount of the toner is reduced and the height of the toner surface is gradually lowered, the position of the subject on the toner surface is also lowered. As a result, the electrostatic capacitance between the two is reduced. Therefore, the electrostatic capacitance between the electrostatic capacitance detection apparatus and the subject changes according to the remaining amount of the toner.

In another conventional image forming apparatus, a permeability sensor is used as an apparatus that detects the amount of a toner in a developing unit. An example of the apparatus that uses the permeability sensor to detect the amount of the developer includes PTL 2. PTL 2 discloses a toner amount detection apparatus that uses a flexible first agitation blade that is transformed backward in a rotation direction based on agitation of the toner, a rigid second agitation blade provided backward in a rotation direction of the first agitation blade, and a permeability sensor provided outside of the bottom of the developing unit. In the apparatus, the permeability sensor provided outside of the bottom of the developing unit detects the state of rotational movements of metallic materials installed on the agitation blades. In the apparatus, the first agitation blade and the second agitation blade integrally make a rotational movement when the amount of the toner in the developing unit is large. The first agitation blade and the second agitation blade separately make rotational movements without transformation when the amount of the toner in the developing unit is small. In this case, when the permeability sensor is used for the detection, the change in the permeability per rotation of the rotation shaft is detected once if the amount of the toner in the developing unit is large. The change is detected twice if the amount of the toner in the developing unit is small. The toner amount detection apparatus detects the amount of the toner in the developing unit based on the change in the number of detections.

CITATION LIST

Patent Literature

PTL 1: Japanese Patent No. 4137703

PTL 2: Japanese Patent Application Laid-Open No. 2002-132036

SUMMARY OF INVENTION

Technical Problem

However, the configurations of the conventional toner remaining amount detection apparatuses have the following problems. As described in PTL 1, if there is more than a certain amount of toner, the coupled section of the flexible member and the agitation member enters the toner. Therefore, the orbits (trajectories) of the flexible member and the subject are almost the same. As a result, if there is more than a certain amount of toner, the distance between the electrostatic capacitance detection apparatus and the subject scarcely changes. Therefore, the detected electrostatic capacitance also scarcely changes, and the remaining amount of the toner cannot be sequentially and accurately detected.

PTL 2 has the following problem. If the amount of the toner is large, the first and second agitation blades integrally make a rotational movement. Therefore, the permeability changes once per rotation of the rotation shaft in the signal detected by the permeability sensor. Meanwhile, if the amount of the toner is small, the first agitation blade is scarcely transformed, and the first and second agitation blades cannot integrally make a rotational movement. In this case, the permeability changes twice per rotation of the rotation shaft in the signal detected by the permeability sensor. The amount or the presence of the toner is alternatively detected based on the number of times (once or twice) of the magnetic field change detected by the permeability sensor. Therefore, it is difficult to sequentially detect the change in the amount of the toner.

An object of the present invention is to provide an image forming apparatus with a simple configuration that can sequentially detect a remaining amount regardless of an amount of a toner and that can accurately detect a remaining amount of a toner even if an agitation member is moving at a high speed.

Another object of the present invention is to allow sequentially detecting a remaining amount with a simple configuration regardless of an amount of a toner and accurately detecting a remaining amount of a toner even if an agitation member is moving at a high speed.

Another object of the present invention is to provide an image forming apparatus including: a developing unit that contains developer and that is detachable; a member that includes a first electrode and that moves around a rotation shaft in the developing unit; a second electrode provided on an outer side of the developing unit; an output unit that detects an electrostatic capacitance between the first electrode and the second electrode and that outputs data related to the detected electrostatic capacitance; and a determination unit that determines an amount of the developer in the developing unit based on the data output from the output unit.

Another object of the present invention is to provide an image forming apparatus including a developing unit that contains developer and that is detachable, the image forming apparatus including: a rotation member that includes a first electrode and that rotates around a rotation shaft in the developing unit, the rotation member being provided on the rotation shaft with flexibility that causes the rotation shaft to be bent by resistance of the developer; a second electrode that is provided at a position where the first electrode is not affected by the resistance of the developer even if the developer is full and that is provided near an outer surface of the developing unit; a third electrode that is provided at a position where the first electrode is affected by the resistance of the developer even if an amount of the developer is smaller than when the developer is full and that is provided near the outer surface of the developing unit; a detection unit that detects an electrostatic capacitance between the first electrode and the second electrode or between the first electrode and the third electrode; a measurement unit that measures a first time at which the detection unit has detected the electrostatic capacitance between the first electrode and the second electrode and a second time at which the detection unit has detected the electrostatic capacitance between the first electrode and the third electrode; and a determination unit that determines an amount of the developer based on a time difference between the first time and the second time measured by the measurement unit.

Another object of the present invention is to provide an image forming apparatus including: a developing unit that contains developer and that is detachable; a first member that includes a first electrode and that moves around a rotation shaft in the developing unit; a second member that includes a second electrode and that is provided on a rotation shaft of the first member to form a predetermined angle with the first member; a third electrode provided on an outer side of the developing unit; an output unit that detects an electrostatic capacitance between the first electrode and the third electrode or between the second electrode and the third electrode and that outputs information related to the detected electrostatic capacitance; and a determination unit that determines an amount of the developer based on a difference between a time at which the output unit has started detecting the electrostatic capacitance between the first electrode and the third electrode and a time at which the output unit has started detecting the electrostatic capacitance between the second electrode and the third electrode.

Another object of the present invention is to provide an image forming apparatus including: a developing unit that contains developer and that is detachable; a first member that includes a first electrode and that moves around a rotation shaft in the developing unit; a second member that includes a second electrode and that is provided on a rotation shaft of the first member to form a predetermined angle with the first member; a third electrode provided on an outer side of the developing unit; an output unit that detects an electrostatic capacitance between the first electrode and the third electrode or between the second electrode and the third electrode and that outputs information related to the detected electrostatic capacitance; and a determination unit that determines an amount of the developer based on a difference between information related to the electrostatic capacitance between the first electrode and the third electrode output by the output unit and information related to the electrostatic capacitance between the second electrode and the third electrode output by the output unit.

Further features of the present invention will become apparent from the following description of exemplary embodiments with reference to the attached drawings.

BRIEF DESCRIPTION OF DRAWINGS

FIGS. 5A, 5B and 5C are diagrams illustrating a characteristic graph, a waveform, and a table T according to the first embodiment.

FIGS. 8A, 8B and 8C are diagrams illustrating a characteristic graph, a waveform, and a table L according to the second embodiment.

FIGS. 14A, 14B, and 14C are a characteristic graph, a waveform of a detection level, and the table T of the first and second embodiments.

FIGS. 19A, 19B, and 19C are a characteristic graph, a waveform, and the table T of the toner remaining amount detection of the sixth embodiment.

FIGS. 21A, 21B, and 21C are a characteristic graph, a waveform, and the table L of the toner remaining amount detection of the seventh embodiment.

DESCRIPTION OF EMBODIMENTS

Further objects of the present invention will become apparent from the detailed description of the invention and with reference to the attached drawings.

First Embodiment

Summary of Image Forming Apparatus

Figure 1:
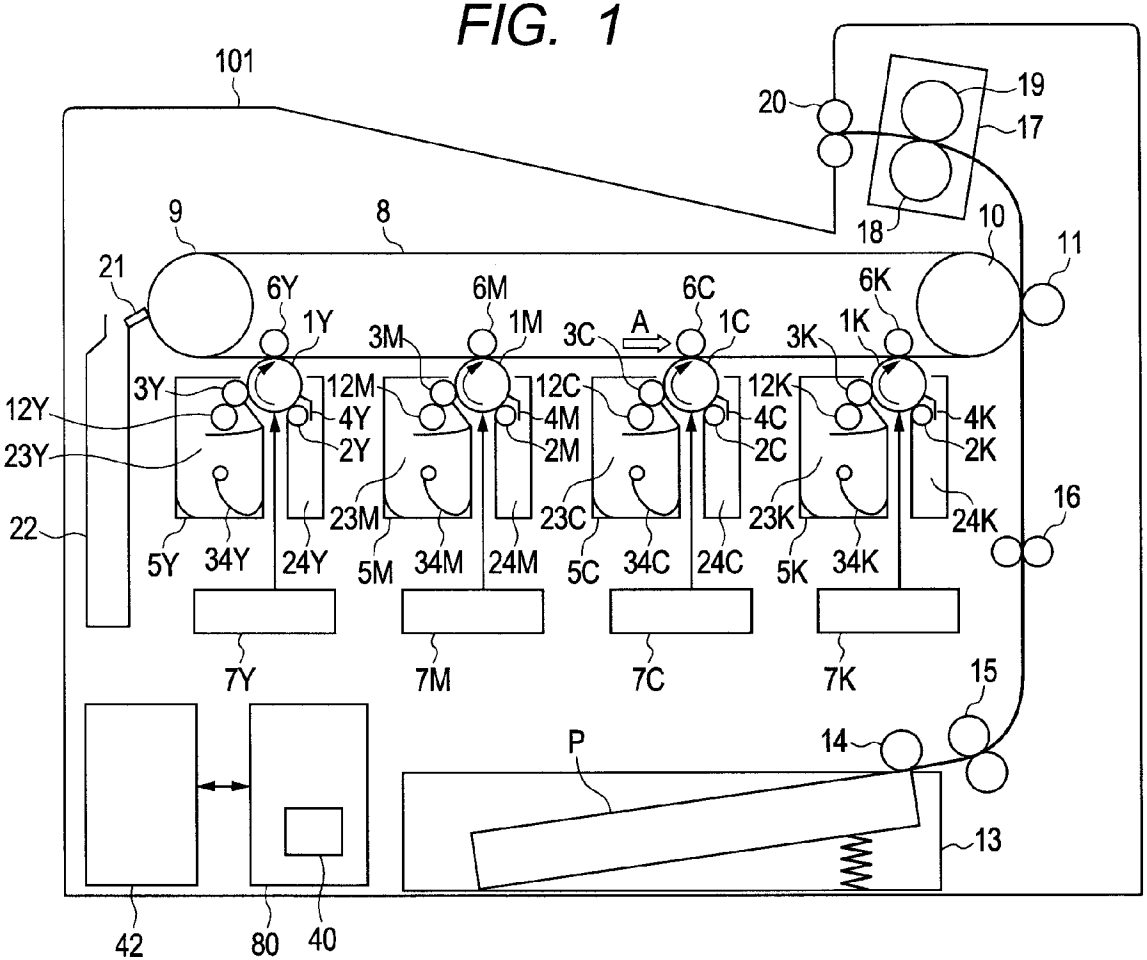
FIG. 1 is a cross-sectional view illustrating an entire configuration of an image forming apparatus of first to third embodiments.

FIG. 1 is a cross-sectional view illustrating an entire configuration of a color laser printer as an example of an image forming apparatus of the present embodiment. A configuration and a basic operation of the color laser printer will be described with reference to FIG. 1. A color laser printer (hereinafter, called "main body") illustrated in FIG. 1 includes process cartridges 5Y, 5M, 5C, and 5K detachable from a main body 101. These four process cartridges 5Y, 5M, 5C, and 5K have the same structure, but are different in that the process cartridges 5Y, 5M, 5C, and 5K form images by toners (developers) of different colors, i.e. yellow (Y), magenta (M), cyan (C), and black (K). Hereinafter, Y, M, C, and K may be omitted and indicated. The process cartridge 5 includes three units: a developing unit; an image forming unit; and a waste toner unit. The developing unit includes a developing roller 3, a toner supply roller 12, a toner container 23, and an agitation element 34. Details of the toner container will be described later. The image forming unit includes a photosensitive drum 1 as an image carrier and a charge roller 2. The waste toner unit includes a cleaning blade 4 and a waste toner container 24.

A laser unit 7 is provided below the process cartridge 5, and the laser unit 7 performs exposure for the photosensitive drum 1 based on an image signal. The charge roller 2 charges the photosensitive drum 1 with a predetermined negative potential, and the laser units 7 form respective electrostatic latent images. The developing rollers 3 reverse and develop the electrostatic latent images to attach negative toners. Y, M, C, and K toner images are formed on the respective photosensitive drums 1. An intermediate transfer belt unit includes an intermediate transfer belt 8, a drive roller 9, and a secondary transfer opposing roller 10. Inside the intermediate transfer belt 8, a primary transfer roller 6 is provided, facing the photosensitive drum 1. A bias applying unit (not illustrated) applies a transfer bias to the primary transfer roller 6.

The toner image formed on the photosensitive drum 1 rotates in an arrow direction of the photosensitive drum 1, and the intermediate transfer belt 8 rotates in an arrow A direction. The bias applying unit (not illustrated) applies a positive bias to the primary transfer roller 6, and toner images on the photosensitive drums 1 are primarily transferred to the intermediate transfer belt 8 in an order of Y, M, C, and K. Four-color toner images are on top of each other and transported to the secondary transfer roller 11. A feeding/transporting apparatus includes: a feed roller 14 that feeds a transfer material P from a feed cassette 13 that stores the transfer material P; and a transport roller pair 15 that transports the fed transfer material P. A registration roller pair 16 transports the transfer material P transported by the feeding/transporting apparatus to the secondary transfer roller 11.

As for the transfer of the toner image from the intermediate transfer belt 8 to the transfer material P, a positive bias is applied to the secondary transfer roller 11 to secondarily transport the toner image on the intermediate transfer belt 8 to the transported transfer material P. The transfer material P provided with the toner image is transported to a fixing apparatus 17, and a fixing film 18 and a pressure roller 19 heat and pressurize the transfer material P. The toner image is fixed on the surface of the transfer material P, and a discharge roller pair 20 discharges the transfer material P. After the transfer to the intermediate transfer belt 8, the cleaning blade 4 removes the toner remained on the surface of the photosensitive drum 1, and the waste toner container 24 collects the removed toner. After the secondary transfer to the transfer material P, a transfer belt cleaning blade 21 removes the toner remained on the intermediate transfer belt 8, and a waste toner container 22 collects the removed toner.

A control board 80 includes a one-chip microcomputer (hereinafter, "CPU") 40 that controls the main body 101 and a storage unit, such as a RAM and a ROM, that stores tables and data. The CPU 40 comprehensively controls operations of the main body 101, such as control of a drive source (not illustrated) related to the transport of the transfer material P and a drive source (not illustrated) of the process cartridge 5, control related to image formation, and control related to failure detection. The CPU 40 further includes a timer inside. The ROM of the storage unit stores programs for controlling image formation operations of the image forming apparatus and various data. The RAM of the storage unit is used for calculation of data necessary to control the image formation operations of the image forming apparatus and for temporary storage. The timer is used to measure time. A video controller 42 controls light emission of the laser in the laser unit based on image data. The video controller 42 interfaces with the user through a control panel (not illustrated), and the control panel displays remaining amounts of the color toners in a bar graph.

Movements of Agitation Element and Detection Member

Figure 2:
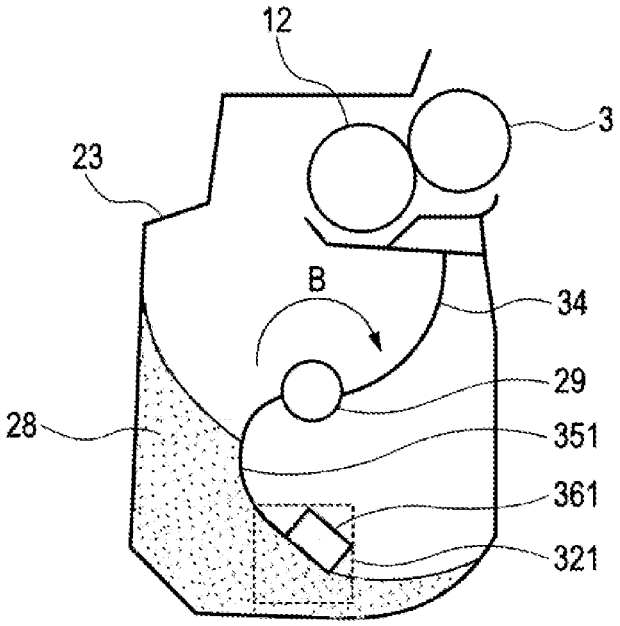
FIG. 2 is a cross-sectional view of a developing unit and an electrostatic capacitance sensor of the first and second embodiments.

FIG. 2 illustrates a cross-sectional view of the developing unit that forms the process cartridge 5 and of an electrostatic capacitance sensor electrode 321 installed on a side of the developing unit. The developing unit of the process cartridge 5 illustrated in FIG. 2 includes the developing roller 3 and the toner supply roller 12. The toner container 23 includes a toner 28 corresponding to the color and the agitation element 34 that agitates the toner. The agitation element 34 is provided on a rotation shaft 29 in the toner container 23, and the agitation element 34 moves around the rotation shaft 29 rotated by a motor not illustrated. A flexible detection member 351 that detects the toner remaining amount is also provided. Like the agitation element 34, the detection member 351 is provided on the rotation shaft 29 in the toner container 23, and the detection member 351 moves around the rotation shaft 29 rotated by the motor not illustrated. A general-purpose Mylar film is used for the detection member 351, and the thickness is thinner than the agitation element 34. Therefore, the amount of bend of the detection member 351 is greater than that of the agitation element 34. The agitation element 34 and the detection member 351 rotate in an arrow B direction at a speed of about 1 rotation/second. The detection member 351 includes a conductive detected electrode 361 at an edge near the wall of the developing unit in the direction of the rotation shaft 29 of the detection member 351, near the leading edge in the circumferential direction that is a direction orthogonal to the rotation shaft 29. The electrostatic capacitance sensor electrode 321 will be described later.

Configurations of Detection Member and Electrostatic Capacitance Sensor

Figure 3A:
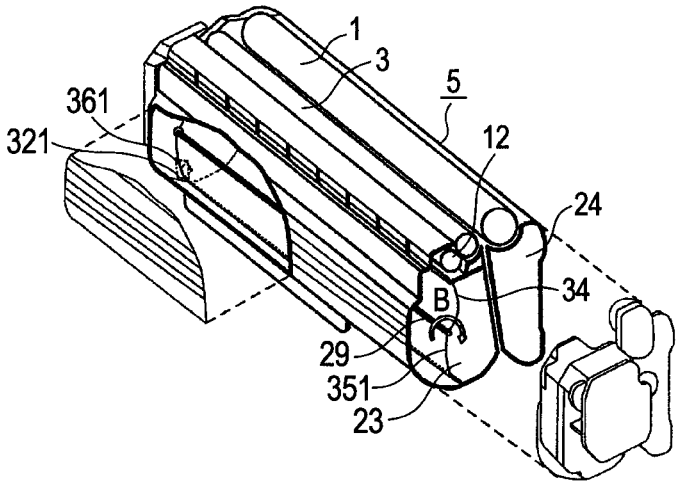
FIGS. 3A, 3B, 3C and 3D are a perspective view of the developing unit, configuration diagrams of the developing unit and an electrostatic capacitance sensor board, and a diagram illustrating a circuit configuration around the electrostatic capacitance sensor of the first and second embodiments.

FIG. 3A illustrates a perspective view of the process cartridge 5. The developing unit of the process cartridge 5 illustrated in FIG. 3A includes the agitation element 34 that agitates the toner (not illustrated) in the toner container 23 and the flexible detection member 351 that detects the toner remaining amount. The agitation element 34 and the detection member 351 are provided on the rotation shaft 29 in the toner container 23 and rotate in the arrow B direction at a speed of about 1 rotation/second. The detection member 351 includes the conductive detected electrode 361 near the leading edge in the circumferential direction of the detection member 351 and at the edge near the wall in the axial direction of the detection member 351.

Figure 3B:
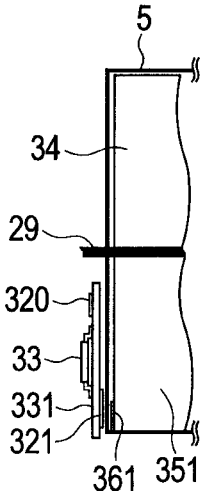
Figure 3C:
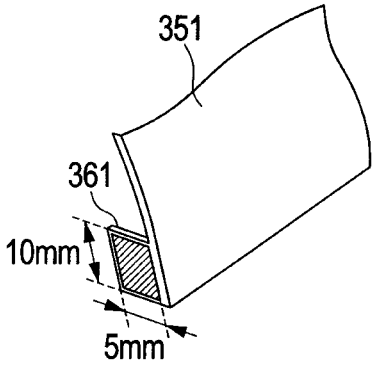

FIG. 3B illustrates a cross-sectional view of part of the developing unit and of an electrostatic capacitance sensor board 331. The electrostatic capacitance sensor board 331 installed near the outer side of the process cartridge 5 illustrated in FIG. 3B is provided on the main body 101, and an electrostatic capacitance sensor 33 and peripheral circuit components (not illustrated) of the electrostatic capacitance sensor 33 are mounted on the electrostatic capacitance sensor board 331. The electrostatic capacitance sensor 33 uses a difference between the electrostatic capacitance based on the electrostatic capacitance sensor electrode 321 and the electrostatic capacitance based on a reference electrode 320 to detect a change in the electrostatic capacitance based on the electrostatic capacitance sensor electrode 321. The electrostatic capacitance sensor electrode 321 and the reference electrode 320 in copper foil patterns and with the same area are provided on the electrostatic capacitance sensor board 331. The outer side of the developing unit approaches the electrostatic capacitance sensor electrode 321 (second electrode) when the process cartridge 5 is mounted on the main body 101. In this state, the electrostatic capacitance sensor 33 detects the electrostatic capacitance generated when the detected electrode 361 provided on the detection member 351 approaches the electrostatic capacitance sensor electrode 321. FIG. 3C is a perspective view indicating a positional relationship between the detection member 351 and the detected electrode 361. The shape of the detected electrode 361 is a rectangle 10 mm long and 5 mm wide. The electrode surface of the detected electrode 361 approaches the electrostatic capacitance sensor electrode 321 when the detection member 351 faces the direction of the gravitational force.

It is only necessary that the electrostatic capacitance sensor 33 and the peripheral circuits can detect the electrostatic capacitance, and analog integrated circuits can also be used instead. Although the electrostatic capacitance sensor electrode 321 is formed on the electrostatic capacitance sensor board 331 provided on the main body 101 in the present embodiment, it is only necessary that the electrostatic capacitance sensor electrode 321 be installed near the side of the developing unit. For example, the electrostatic capacitance sensor electrode 321 may be directly formed on the side of the developing unit. In that case, electrical contacts can be provided for the electrostatic capacitance sensor board 331 and the electrostatic capacitance sensor electrode 321, and the electrostatic capacitance sensor board 331 and the electrostatic capacitance sensor electrode 321 can be connected when the process cartridge 5 is mounted on the main body 101.

Circuit Configuration of Electrostatic Capacitance Sensor

Figure 3D:
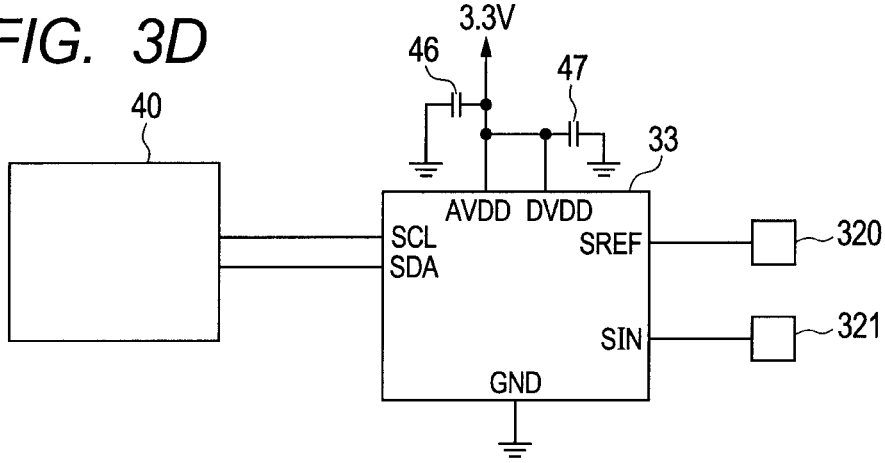

FIG. 3D is a diagram illustrating a connection relationship between the electrostatic capacitance sensor 33, the CPU 40, the reference electrode 320, and the electrostatic capacitance sensor electrode 321 according to the present embodiment. In FIG. 3D, AVDD of the electrostatic capacitance sensor 33 denotes an analog power terminal, and DVDD denotes a digital power terminal. Bypass capacitors 46 and 47 are provided to remove noise of the power terminals. The reference electrode 320 is connected to an SREF terminal, and the electrostatic capacitance sensor electrode 321 is connected to an SIN terminal. Data is transmitted and received through serial communication between the CPU 40 and the electrostatic capacitance sensor 33. The CPU 40 supplies a clock signal for synchronizing communication to an SCL terminal of the electrostatic capacitance sensor 33. The electrostatic capacitance sensor 33 outputs 8-bit detection data corresponding to the value of the detected electrostatic capacitance to the CPU 40 through an SDA terminal. Conversely, the CPU 40 inputs setting data for controlling the electrostatic capacitance sensor 33 to the electrostatic capacitance sensor 33 through the SDA terminal.

Movement of Detection Member

Figure 4A:
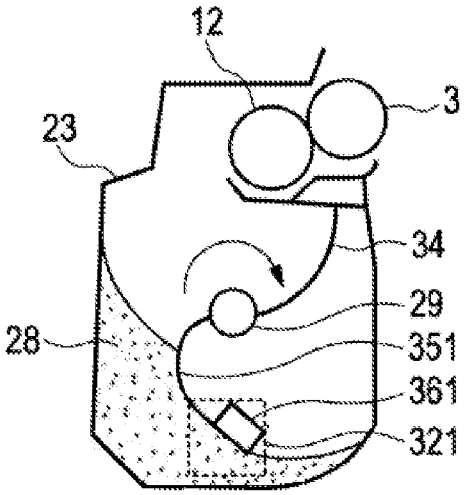
FIGS. 4A, 4B, 4C and 4D are diagrams illustrating movements of a detection member when there is a large amount of toner and when there is a small amount of toner of the first embodiment.
Figure 4B:
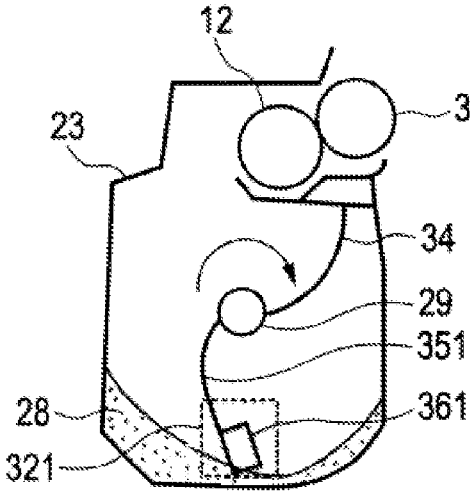
Figure 4C:
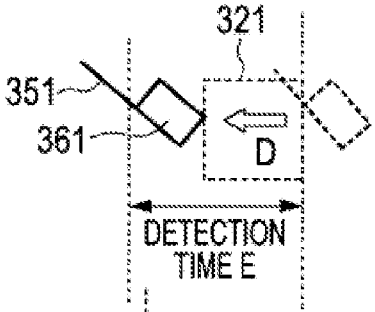
Figure 4D:
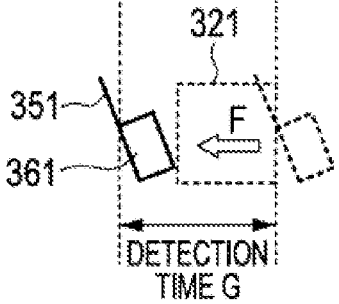

FIG. 4A illustrates a cross-sectional view of the developing unit when the remaining amount of the toner 28 is relatively large. FIG. 4B illustrates a cross-sectional view of the developing unit when the remaining amount of the toner 28 is relatively small. FIG. 4C is a diagram illustrating a transit of the detected electrode 361 over the detection surface of the electrostatic capacitance sensor electrode 321 when the remaining amount of the toner 28 is relatively large. FIG. 4D is a diagram illustrating a transit of the detected electrode 361 over the detection surface of the electrostatic capacitance sensor electrode 321 when the remaining amount of the toner 28 is relatively small. When the detection member 351 makes a rotational movement, the detection member is affected by the resistance of the toner 28 and is transformed backward in the rotation direction. The detection member 351 rotates while being bent. The detected electrode 361 provided near the leading edge of the detection member 351 passes over the detection surface of the electrostatic capacitance sensor electrode 321. As illustrated in FIG. 4A, if the remaining amount of the toner 28 is relatively large, the detection member 351 is significantly affected by the resistance of the toner when passing over the detection surface of the electrostatic capacitance sensor electrode 321. Therefore, as illustrated in FIG. 4C, the detected electrode 361 is tilted in the horizontal direction when the detected electrode 361 passes in an arrow D direction over the detection surface of the electrostatic capacitance sensor electrode 321. In this case, a detection time of the detection of the electrostatic capacitance by the electrostatic capacitance sensor 33 when the detected electrode 361 passes over the detection surface of the electrostatic capacitance sensor electrode 321 is E.

Conversely, as illustrated in FIG. 4B, the resistance of the toner 28 when the detection member 351 passes over the detection surface of the electrostatic capacitance sensor electrode 321 is small if the remaining amount of the toner 28 is relatively small, compared to when the remaining amount of the toner 28 is large. Therefore, as illustrated in FIG. 4D, when the detected electrode 361 passes in an arrow F direction over the detection surface of the electrostatic capacitance sensor electrode 321, the tilt of the detected electrode 361 is closer to the vertical direction compared to FIG. 4C. In this case, the detection time of the detection of the electrostatic capacitance by the electrostatic capacitance sensor 33 when the detected electrode 361 passes over the detected surface of the electrostatic capacitance sensor electrode 321 is G.

As illustrated in FIGS. 4C and 4D, the time G of the detection of the electrostatic capacitance by the electrostatic capacitance sensor 33 when the remaining amount of the toner 28 is small is shorter than the time E of the detection of the electrostatic capacitance by the electrostatic capacitance sensor 33 when the remaining amount of the toner 28 is large. Therefore, the time of transit by the detected electrode 361 over the detection surface, for which the electrostatic capacitance sensor electrode 321 can detect the electrostatic capacitance, changes according to the remaining amount of the toner 28. This principle is used in the present embodiment to detect the remaining amount of the toner 28.

Detection Characteristics of Toner Remaining Amount Detection

Toner remaining amount detection characteristics according to the present embodiment will be described with reference to FIGS. 5A to 5C. In the present embodiment, a time width PW of the detection of the detected electrode 361 by the electrostatic capacitance sensor 33 is measured N times, and a total value SUM of the detected time widths is divided by the number of measurements N to calculate an average time width. The reason that the average value of the time widths of N times is calculated is to reduce variations in the time width caused by variations in the detection timing of the electrostatic capacitance sensor 33 to improve the detection accuracy. Although the average time width is used to calculate the remaining amount of the toner 28 in the present embodiment, the calculation method of the average value is an example and is not limited to this. In the following embodiments, the detection level of the electrostatic capacitance sensor 33 is output to the CPU 40 as 8-bit data, and the numerical values of the detection level are expressed in decimal.

FIG. 5A is a characteristic graph indicating a relationship between the remaining amount of the toner 28 in the toner container 23 and the average time width of the detection of the detected electrode 361 by the electrostatic capacitance sensor 33. The vertical axis denotes the average time width (msec (milliseconds)), and the horizontal axis denotes the toner remaining amount (%). As illustrated in the characteristic graph of FIG. 5A, the average time width when the toner remaining amount is 0% is 45.5 msec (milliseconds), and the average time width when the toner remaining amount is 100% is 113.6 msec (milliseconds). FIG. 5B illustrates waveform data plotting detection level data output from the electrostatic capacitance sensor 33 to the CPU 40 when the toner remaining amount is 80%. The vertical axis denotes the detection level, and the horizontal axis denotes the time (msec (milliseconds)). In the present embodiment, it is determined that the detected electrode 361 is passing over the detection surface of the electrostatic capacitance sensor electrode 321 if the level of detection by the electrostatic capacitance sensor 33 is equal to or more than 150. The time width PW is obtained by measuring the time width when the detection level is equal to more than 150, and in FIG. 5B, the average time width when the detection level is equal to or more than 150 is 91.9 msec (milliseconds). FIG. 5C illustrates a table T indicating a correspondence between the average time width (msec) and the toner remaining amount (%) based on the characteristic graph of FIG. 5A. The remaining amount of the toner 28 corresponding to the average time width not specified in the table T can be obtained by linear interpolation of the known remaining amount of the toner 28 described in the table T. The measured average time width is a value in the present embodiment. Therefore, the measured average time width changes if the measurement conditions change. The same applies to the numerical value of the table T for determining the remaining amount of the toner 28. The information of the table T is written in advance at a factory in the ROM of the storage unit or in a ROM provided in the process cartridge 5 and is shipped. The CPU 40 reads the information of the table T written in the ROM provided in the process cartridge 5 when the process cartridge 5 is mounted on the main body 101, and the information is stored in the RAM of the storage unit of the control board 80. It is assumed that the table information is also recorded in the ROM or the RAM of the recording unit based on the methods in second and third embodiments described later. The method of recording the table information upon the shipment is an example and is not limited to this.

Processing Sequence of Toner Remaining Amount Detection

A processing sequence of the remaining amount detection of the toner according to the present embodiment will be described with reference to flow charts of FIGS. 6A and 6B. The CPU 40 executes the process illustrated in FIGS. 6A and 6B based on a control program stored in the ROM of the storage unit. The CPU 40 similarly executes processes of flow charts in the following embodiments. If Application Specific Integrated Circuits (ASIC) are included in the image forming apparatus, the ASIC may have a function of executing any of the processes in the flow charts, instead of the CPU 40 executing all processes illustrated in the flow charts.

In step 101 (hereinafter, described as "S101"), the CPU 40 rotates the detection member 351. In the present embodiment, the time required for one rotation of the detection member 351 is about one second. In S102, the CPU 40 performs serial communication with the electrostatic capacitance sensor 33 to perform initial setting of the electrostatic capacitance sensor and resets and starts the timer for monitoring sensor abnormality. The CPU 40 further sets the variable N, which indicates the number of measurements, and the variable SUM, which indicates the total value of the detected time widths with the detection level equal to or more than a predetermined value, to 0.

In S103, the CPU 40 receives read data of the detection level from the electrostatic capacitance sensor 33 through serial communication. In S104, the CPU 40 determines whether the detection level is less than 140 for equal to or more than 0.5 second based on the read data. If the detection level is less than 140 for equal to or more than 0.5 second, the CPU 40 determines that the level is in an initial state in which the detected electrode 361 is not passing over the detection surface of the electrostatic capacitance sensor electrode 321, and the CPU 40 proceeds to S106. Otherwise, the CPU 40 proceeds to S105. In S105, the CPU 40 reads a timer value of the timer for monitoring sensor abnormality and determines whether the timer value indicates equal to or more than two seconds. If the timer value indicates less than two seconds, the CPU 40 returns to S103. If the timer value indicates equal to or more than two seconds, the CPU 40 proceeds to S121. In S121, the CPU 40 determines that the electrostatic capacitance sensor 33 is abnormal and notifies the video controller 42 of the abnormality.

In S106, the CPU 40 adds 1 to the variable N indicating the number of measurements and resets and starts the timer for monitoring sensor abnormality. In S107, the CPU 40 receives read data of the detection level from the electrostatic capacitance sensor 33 through serial communication. In S108, the CPU 40 determines whether the detection level is equal to or more than 150 (ascending flank threshold) based on the read data. If the detection level is equal to or more than 150, the CPU 40 determines that there is an ascending flank of the detection level (state in which the detected electrode 361 is reaching the detection surface of the electrostatic capacitance sensor electrode 321), and the CPU 40 proceeds to S110. Otherwise, the CPU 40 proceeds to S109. In S109, the CPU 40 reads the timer value of the timer for monitoring sensor abnormality and determines whether the timer value indicates equal to or more than two seconds. If the timer value indicates less than two seconds, the CPU 40 returns to S107. If the timer value indicates equal to or more than two seconds, the CPU 40 proceeds to S121. In S121, the CPU 40 determines that the electrostatic capacitance sensor 33 is abnormal and notifies the video controller 42 of the abnormality.

In S110, the CPU 40 that has recognized the ascending flank of the detection level resets and starts a timer for transit time measurement to measure the time required by the detected electrode 361 to pass over the detection surface of the electrostatic capacitance sensor electrode 321. In S111, the CPU 40 receives read data of the detection level from the electrostatic capacitance sensor 33 through serial communication. In S112, the CPU 40 determines whether the detection level is less than 150 (descending flank threshold) based on the read data. If the detection level is less than 150, the CPU 40 determines that there is a descending flank of the detection level (state in which the detected electrode 361 has passed over the detection surface of the electrostatic capacitance sensor electrode 321), and the CPU 40 proceeds to S114. Otherwise, the CPU 40 proceeds to S113. In S113, the CPU 40 reads the timer value of the transit time measurement timer and determines whether the time value indicates equal to or more than two seconds. If the timer value indicates less than two seconds, the CPU 40 returns to S111. If the timer value indicates equal to or more than two seconds, the CPU 40 proceeds to S121. In S121, the CPU 40 determines that the electrostatic capacitance sensor 33 is abnormal and notifies the video controller 42 of the abnormality.

In S114, the CPU 40 that has detected the descending flank of the detection level stops the timer for transit time measurement. In S115, the CPU 40 reads the timer value PW, which is the time required by the detected electrode 361 to pass over the detection surface of the electrostatic capacitance sensor electrode 321, from the timer for transit time measurement. In S116, the CPU 40 adds the read timer value PW to the variable SUM indicating the total value of the detected time widths. In S117, the CPU 40 determines whether the value of the variable N indicating the number of measurements is 5. If the value is not 5, the CPU 40 returns to S106. If the value is 5, the CPU 40 proceeds to S118. Although the number of measurements is 5 in the present embodiment, this is an example. The number of measurements can be increased to improve the accuracy of the detected time width, and the number of measurements can be reduced to reduce the processing time required to calculate the toner remaining amount.

In S118, the CPU 40 divides the value of the variable SUM, which is the total value of the detected time widths of five times, by five to calculate the average value of the detected time widths. In S119, the CPU 40 checks up the average value of the detected time widths calculated in S118 and the average time width of the table T stored in the ROM of the storage unit to calculate the corresponding remaining amount of the toner 28. In S120, the CPU 40 notifies the video controller 42 of the remaining amount of the toner 28 calculated in S119.

An example of setting the threshold of the detection level to 150 and measuring the time width with the detection level equal to or more than 150 has been described in the control sequence of the present embodiment. The threshold 150 of the detection level is an example, and an initial level of a stable detection level can be detected to set the level plus something extra as a threshold. The time width with the detection level equal to or more than the threshold can be measured, and the time width can be checked up in the table T. Such a sequence can also be applied.

As described, according to the present embodiment, the remaining amount can be sequentially detected with a simple configuration, regardless of the amount of the toner. The remaining amount of the toner can be accurately detected at a high speed even if the agitation member is moving. According to the configuration and the operation, the time width of the detection of the detected electrode by the electrostatic capacitance sensor monotonically decreases, from 100% to 0% of the remaining amount of the toner. As a result, the time width of the detection of the detected electrode by the electrostatic capacitance sensor can be measured, and the time width can be checked up in the table to sequentially detect the remaining amount of the toner, from the state in which the toner is full until the toner is empty. The reaction rate of the electrostatic capacitance sensor system is high. Therefore, the acceleration of the detection time and the image formation operation can be performed at the same time. The bend of the detection member is stable in accordance with the remaining amount of the toner even if the detection member is rotating at a high speed. Therefore, the remaining amount of the toner can be sequentially detected.

Second Embodiment

An embodiment of detecting the remaining amount of the toner based on the time width of the detection of the detected electrode 361 by the electrostatic capacitance sensor 33 has been described in the first embodiment. In the present embodiment, with the same configuration as the first embodiment, an example of detecting the remaining amount of the toner based on an average value of the detection levels of the electrostatic capacitance (electrostatic capacitance values) of the detection of the detected electrode 361 by the electrostatic capacitance sensor 33 will be described. The configurations of FIGS. 1, 2, and 3A to 3D described in the first embodiment will also be applied to the present embodiment. The same configurations as in the first embodiment are designated with the same reference numerals, and the configurations are described in detail in the first embodiment. Therefore, the description will not be repeated in the present embodiment.

Movement of Detection Member

Figure 7A:
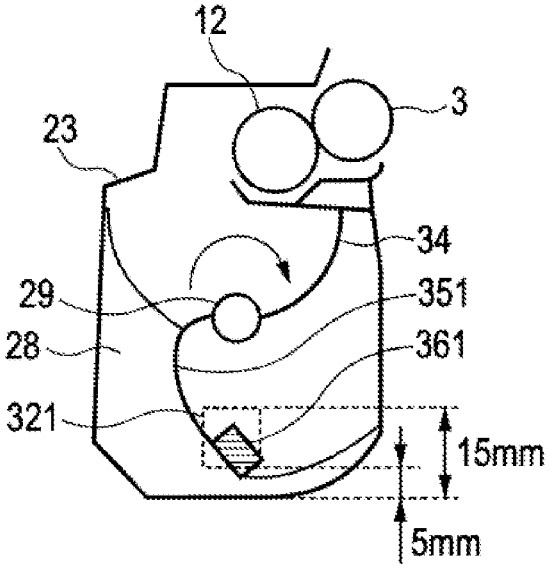
FIGS. 7A and 7B are diagrams illustrating movements of the detection member when there is a large amount of toner and when there is a small amount of toner of the second embodiment.
Figure 7B:
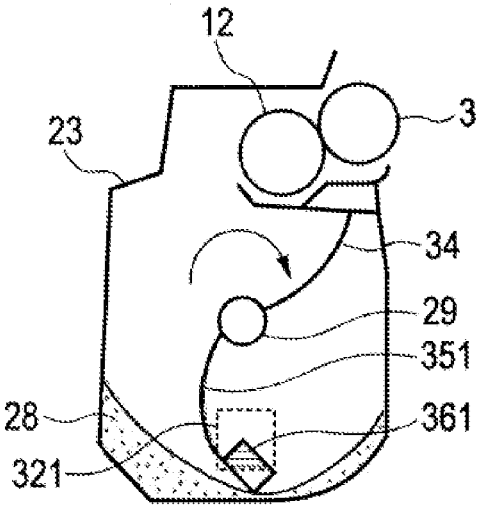

FIG. 7A illustrates a cross-sectional view of the developing unit when the remaining amount of the toner 28 is relatively large. FIG. 7B illustrates a cross-sectional view of the developing unit when the remaining amount of the toner 28 is relatively small. In the present embodiment, as illustrated in FIG. 7A, the electrostatic capacitance sensor electrode 321 is in the direction of the gravitational force of the developing unit and is provided at a position about 5 mm to 15 mm above the bottom of the developing unit. When the detection member 351 makes a rotational movement, the detection member is affected by the resistance of the toner 28 and is transformed backward in the rotation direction. The detection member 351 rotates while being bent. The detected electrode 361 provided near the leading edge of the detection member 351 passes over the detection surface of the electrostatic capacitance sensor electrode 321. As illustrated in FIG. 7A, if the remaining amount of the toner 28 is relatively large, the detection member 351 is significantly affected by the resistance of the toner and largely bent when passing over the detection surface of the electrostatic capacitance sensor electrode 321. The detected electrode 361 passes through a position away from the bottom of the developing unit. Therefore, when the detected electrode 361 passes over the detection surface of the electrostatic capacitance sensor electrode 321, the area where the detected electrode 361 and the electrostatic capacitance sensor electrode 321 overlap (shaded section of FIG. 7A) increases. As a result, the level of the detection of the electrostatic capacitance by the electrostatic capacitance sensor 33 increases.

Conversely, as illustrated in FIG. 7B, the resistance of the toner 28 when the detection member 351 passes over the detection surface of the electrostatic capacitance sensor electrode 321 is small if the remaining amount of the toner 28 is relatively small, and the detected electrode 361 passes through a position near the bottom of the developing unit. Therefore, when the detected electrode 361 passes over the detection surface of the electrostatic capacitance sensor electrode 321, the area where the detected electrode 361 and the electrostatic capacitance sensor electrode 321 overlap (shaded section of FIG. 7B) is narrowed down. As a result, the level of the detection of the electrostatic capacitance by the electrostatic capacitance sensor 33 decreases.

In the present embodiment, the detection member 351 is affected by the resistance of the toner 28 and largely bent when the toner remaining amount is 100%. The detection member 351 makes a rotational movement at a position about 5 mm above the bottom of the developing unit. At this point, the area where the detected electrode 361 and the detection surface of the electrostatic capacitance sensor electrode 321 overlap is maximized. The position of the detection member 351 from the bottom of the developing unit is lowered with a decrease in the remaining amount of the toner 28. As a result, the area where the detected electrode 361 and the detection surface of the electrostatic capacitance sensor electrode 321 overlap is also narrowed down. More specifically, when the detected electrode 361 passes over the detection surface for which the electrostatic capacitance sensor electrode 321 can detect the electrostatic capacitance, the area where the detection surface and the detected electrode 361 overlap changes according to the remaining amount of the toner 28. This principle is used in the present embodiment to detect the remaining amount of the toner 28.

Detection Characteristics of Toner Remaining Amount Detection

Toner remaining amount detection characteristics according to the present embodiment will be described with reference to FIGS. 8A to 8C. In the present embodiment, an average value LV of the detection level in the detection of the detected electrode 361 by the electrostatic capacitance sensor 33 is calculated. The reason that the average value is calculated is to reduce the influence of the detection level falsely detected due to noise to improve the detection accuracy. This is measured N times, and a total value SUM obtained by adding the average values LV of the detection level is divided by the number of measurements N to calculate the average value of the detection level. The reason that the average value of the detection level of N times is calculated is to reduce variations in the detection level caused by variations in the detection timing of the electrostatic capacitance sensor 33 to improve the detection accuracy. Although the average value of the detection level is used to calculate the remaining amount of the toner 28 in the present embodiment, the calculation method of the average value is an example and is not limited to this.

FIG. 8A is a characteristic graph indicating a relationship between the remaining amount of the toner 28 in the toner container 23 and the average value of the detection level of the electrostatic capacitance sensor 33. The vertical axis denotes the average value of the detection level, and the horizontal axis denotes the toner remaining amount (%). As illustrated in the characteristic graph of FIG. 8A, the average value of the detection level when the toner remaining amount is 0% is 156.1, and the average value of the detection level when the toner remaining amount is 100% is 172.2. FIG. 8B illustrates waveform data plotting detection level data output from the electrostatic capacitance sensor 33 to the CPU 40 when the toner remaining amount is 80%. The vertical axis denotes the detection level, and the horizontal axis denotes the time (msec (milliseconds)). In the present embodiment, it is determined that the detected electrode 361 is passing over the detection surface of the electrostatic capacitance sensor electrode 321 if the level of the detection by the electrostatic capacitance sensor 33 is equal to or more than 150. The average value of the detection level is an average value of the detection levels measured when the detection level is equal to or more than 150. In FIG. 8B, the measured average value of the detection level when the detection level of the electrostatic capacitance sensor 33 is equal to or more than 150 is 169.4. FIG. 8C illustrates a table L indicating a correspondence between the average value of the detection level and the toner remaining amount (%) based on the characteristic graph of FIG. 8A. The remaining amount of the toner 28 corresponding to an average value of the detection level not specified in the table L can be obtained by linear interpolation of the known remaining amount of the toner 28 described in the table L. The measured average value of the detection level is a value in the present embodiment. Therefore, the measured average value changes if the measurement conditions change. The same applies to the numerical values of the table L for determining the remaining amount of the toner 28.

Processing Sequence of Toner Remaining Amount Detection

Figures 9, 9A:
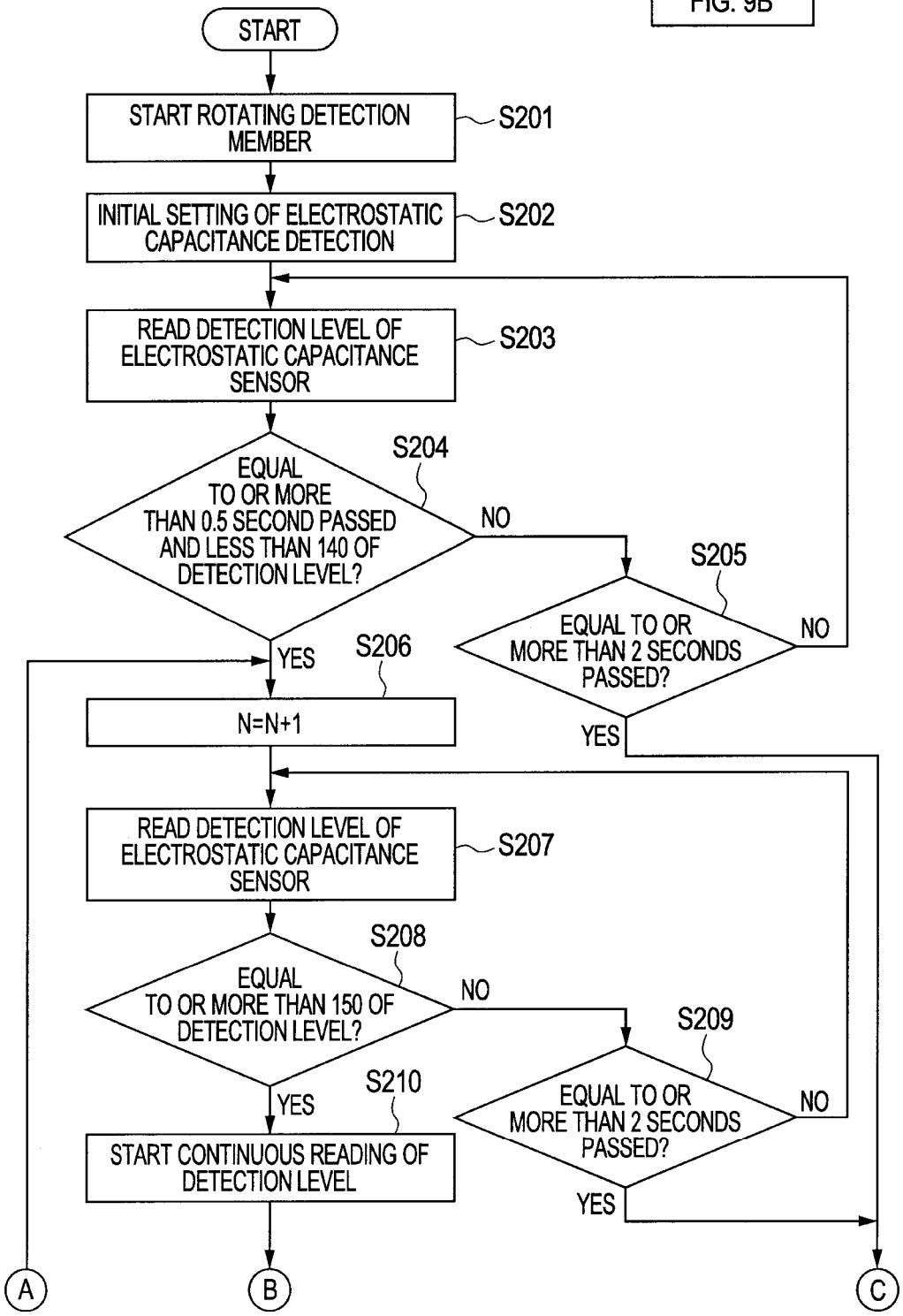
FIG. 9 is comprised of FIGS. 9A and 9B showing flow charts illustrating a processing sequence of the toner remaining amount detection of the second embodiment.
Figure 9B:
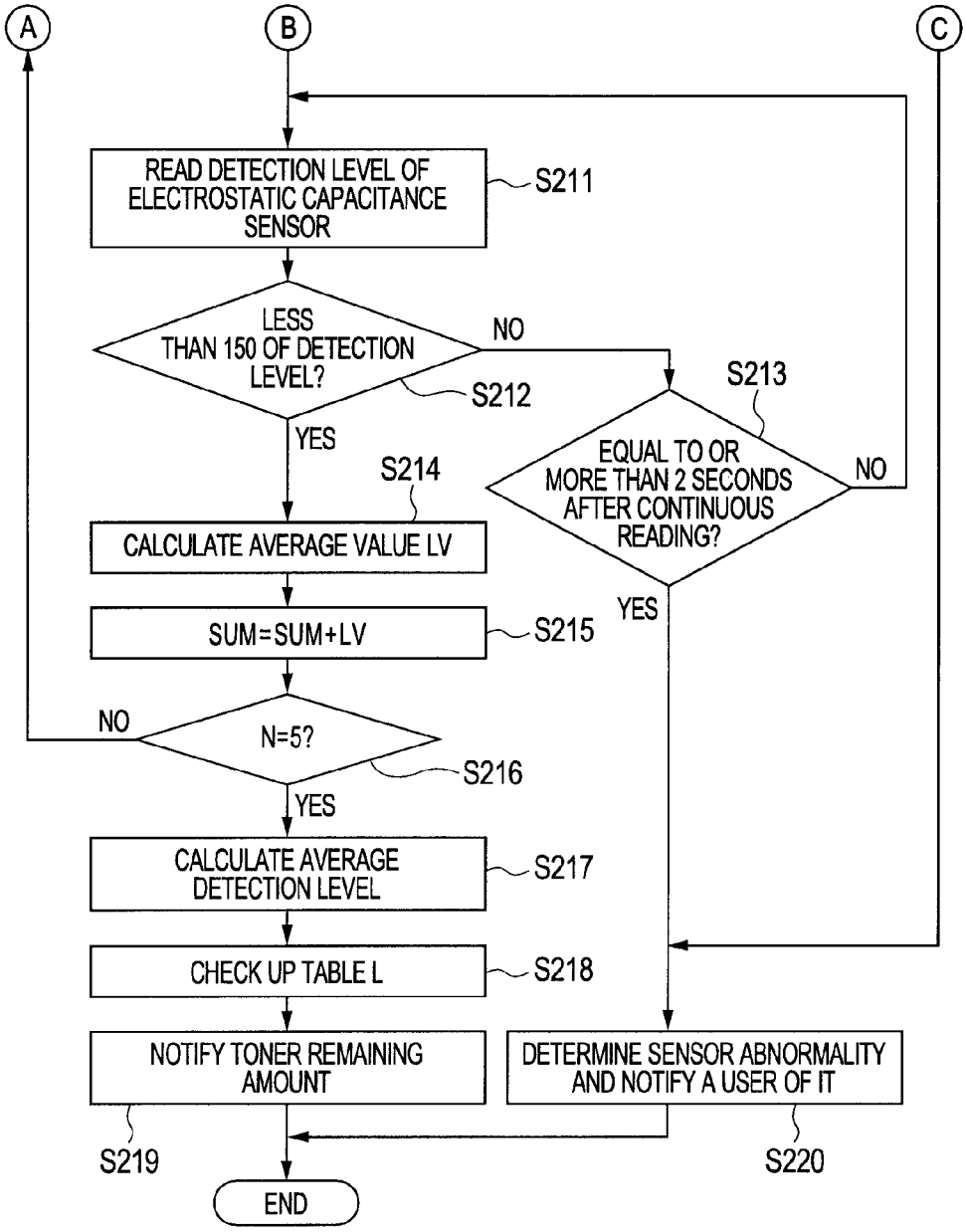

A sequence of detecting the toner remaining amount according to the present embodiment will be described with reference to flow charts of FIGS. 9A and 9B. The process of S201 to S209 of FIGS. 9A and 9B is the same as S101 to S109 of the flow charts of FIGS. 6A and 6B of the first embodiment, and the description will not be repeated.

In S210, the CPU 40 sets 0 to the memory storing the total value of the read detection level data and resets and starts the timer that measures the time of transit by the detected electrode 361 over the detection surface of the electrostatic capacitance sensor electrode 321 to start continuous reading of the detection level. In S211, the CPU 40 receives read data of the detection level from the electrostatic capacitance sensor 33 through serial communication. In S212, the CPU 40 determines whether the detection level is less than 150 (descending flank threshold) based on the read data. If the detection level is less than 150, the CPU 40 determines that there is a descending flank of the detection level (state in which the detected electrode 361 has passed over the detection surface of the electrostatic capacitance sensor electrode 321), and the CPU 40 proceeds to S214. Otherwise, the CPU 40 proceeds to S213. In S213, the CPU 40 adds the detection level data read in S211 to the memory storing the total value of the detection level data and reads the timer value of the transit time measurement timer to determine whether the timer value indicates equal to or more than two seconds. If the timer value indicates less than two seconds, the CPU 40 returns to S211. If the timer value indicates equal to or more than two seconds, the CPU 40 proceeds to S220. In S220, the CPU 40 determines that the electrostatic capacitance sensor 33 is abnormal and notifies the video controller 42 of the abnormality.

In S214, the CPU 40 reads the total value from the memory storing the total value of the detection level data and divides the total value by the number of the stored detection level data to calculate the average value LV of the detection level data. In S215, the CPU 40 adds the average value LV calculated in S214 to the variable SUM indicating the total value of the detection level. In S216, the CPU 40 determines whether the value of the variable N indicating the number of measurements is 5. If the value is not 5, the CPU 40 returns to S206. If the value is 5, the CPU 40 proceeds to S217.

In S217, the CPU 40 divides the value of the variable SUM, which is the sum of the average values of the detection level data of five times, by 5 to calculate the average value of the detection level. In S218, the CPU 40 checks up the average value of the detection level calculated in S217 and the average value of the detection level of the table L stored in the ROM of the storage unit to calculate the remaining amount of the corresponding toner 28. In S219, the CPU 40 notifies the video controller 42 of the remaining amount of the toner 28 calculated in S218.

As described, according to the present embodiment, the remaining amount can be sequentially detected with a simple configuration, regardless of the amount of the toner. The remaining amount of the toner can be accurately detected at a high speed even if the agitation member is moving. According to the configuration and the operation, the average value of the detection level when the electrostatic capacitance sensor is detecting the detected electrode monotonically decreases, from 100% to 0% of the remaining amount of the toner. As a result, the average value of the detection level when the electrostatic capacitance sensor is detecting the detected electrode can be measured, and the average value can be checked up in the table to sequentially detect the remaining amount of the toner, from the state in which the toner is full until the toner is empty. The reaction rate of the electrostatic capacitance sensor system is high. Therefore, the acceleration of the detection time and the image formation operation can be performed at the same time. The bend of the detection member is stable in accordance with the remaining amount of the toner even if the detection member is rotating at a high speed. Therefore, the remaining amount of the toner can be sequentially detected. A combination of the processing sequence of the time width detection at the timing of the change in the electrostatic capacitance of the first embodiment and the processing sequence of the level detection with changing electrostatic capacitance of the present embodiment can handle configurations of various process cartridges.

Third Embodiment

An embodiment of detecting the remaining amount of the toner based on the time width of the detection of the detected electrode 361 by the electrostatic capacitance sensor 33 has been described in the first embodiment. In the present embodiment, an example of arranging, on the detection member, a detected electrode with a length from the rotation shaft to the leading edge in the circumferential direction to allow more accurate detection of the remaining amount of the toner 28 compared to the first embodiment will be described. If the remaining amount of the toner 28 is large, the detected electrode 361 provided on the detection member is largely bent. The area overlapping with the detection surface of the electrostatic capacitance sensor electrode 321 decreases, while the time overlapping with the detection surface increases. As a result, although the maximum value of the detection level detected by the electrostatic capacitance sensor 33 is reduced compared to the first embodiment, the time width of the detection of the detected electrode 361 can be increased. Therefore, the configuration of the present detected electrode can be applied if the sensitivity of detecting the electrostatic capacitance of the electrostatic capacitance sensor 33 can be secured. The configurations of FIGS. 1, 2, and 3A to 3D described in the first embodiment will also be applied to the present embodiment. The same configurations as in the first embodiment are designated with the same reference numerals, and the configurations are described in detail in the first embodiment. Therefore, the description will not be repeated in the present embodiment.

Configurations of Detection Member and Electrostatic Capacitance Sensor

Figure 10A:
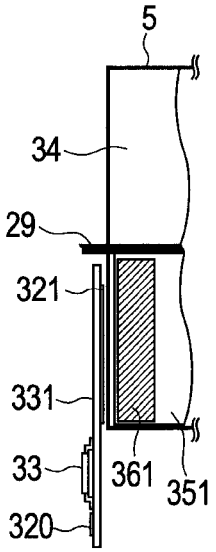
FIGS. 10A and 10B are diagrams illustrating configurations of the developing unit and the electrostatic capacitance sensor board of the third embodiment.
Figure 10B:
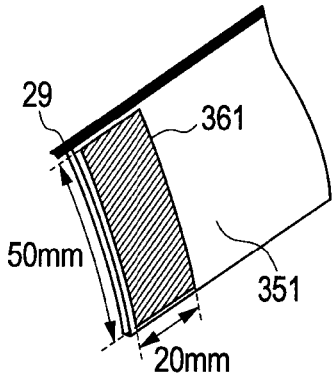

FIG. 10A illustrates a cross-sectional view of part of the developing unit and of the electrostatic capacitance sensor board 331. The electrostatic capacitance sensor board 331 installed near the side of the process cartridge 5 illustrated in FIG. 10A is provided on the main body 101. The electrostatic capacitance sensor electrode 321 and the reference electrode 320 in copper foil patterns are provided on the electrostatic capacitance sensor board 331. The electrostatic capacitance sensor electrode 321 is provided from near the rotation shaft 29 to the bottom in the circumferential direction of the developing unit. The reference electrode 320 has a copper foil pattern with the same area as the electrostatic capacitance sensor electrode 321 and is provided at a position away from the developing unit to prevent being affected by the detected electrode 361. FIG. 10B is a perspective view indicating a positional relationship between the detection member 351 and the detected electrode 361. The shape of the detected electrode 361 is a rectangle 50 mm long and 20 mm wide. The electrode surface of the detected electrode 361 approaches the electrostatic capacitance sensor electrode 321 when the detection member 351 faces the direction of the gravitational force. Although the width of the detected electrode 361 is 20 mm here, the width of the detected electrode 361 can be smaller if the detection level detected by the electrostatic capacitance sensor 33 is sufficient.

Movement of Detection Member

Figure 11A:
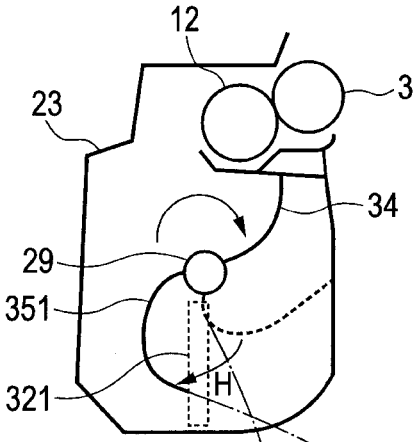
FIGS. 11A, 11B, and 11C are diagrams illustrating movements of the detection member when there is a large amount of toner and when there is a small amount of toner of the third embodiment.
Figure 11B:
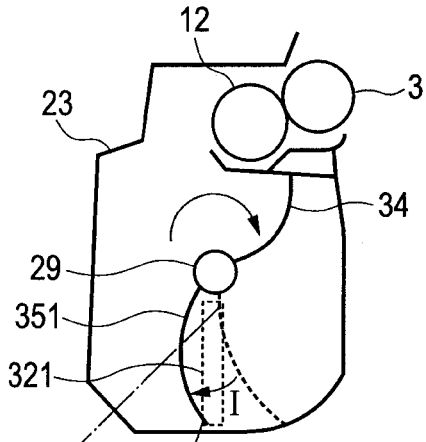
Figure 11C:
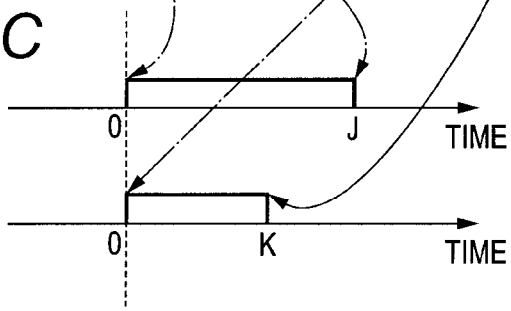

FIG. 11A illustrates a cross-sectional view of the developing unit when the remaining amount of the toner 28 is relatively large. FIG. 11B illustrates a cross-sectional view of the developing unit when the remaining amount of the toner 28 is relatively small. FIG. 11C illustrates time widths of the detection of the detected electrode 361 by the electrostatic capacitance sensor electrode 321 when the remaining amount of the toner 28 is relatively large and when the remaining amount of the toner 28 is relatively small. Although the toner amounts are not illustrated in FIGS. 11A and 11B, the toner amounts are equivalent to those of FIGS. 4A and 4B, respectively. If the remaining amount of the toner 28 is relatively large, the detection member 351 is significantly affected by the resistance of the toner when passing over the detection surface of the electrostatic capacitance sensor electrode 321. Therefore, as illustrated in FIG. 11A, the detection member 351 approaches from near the rotation shaft 29 to the electrostatic capacitance sensor electrode 321 and proceeds in an arrow H direction over the detection surface of the electrostatic capacitance sensor electrode. Lastly, the leading edge in the circumferential direction of the detection member 351 moves away from the detection surface of the electrostatic capacitance sensor electrode. A time J of FIG. 11C indicates a time width of the detection of the electrostatic capacitance by the electrostatic capacitance sensor 33 in FIG. 11A.

Meanwhile, if the remaining amount of the toner 28 is relatively small, the resistance of the toner 28 is reduced when the detection member 351 passes over the detection surface of the electrostatic capacitance sensor electrode 321, compared to when the remaining amount of the toner 28 is relatively large. Therefore, as illustrated in FIG. 11B, the detection member 351 approaches the electrostatic capacitance sensor electrode 321 from near the rotation shaft 29 and proceeds in an arrow I direction over the detection surface of the electrostatic capacitance sensor electrode. Lastly, the leading edge in the circumferential direction of the detection member 351 moves away from the detection surface of the electrostatic capacitance sensor electrode. A time K of FIG. 11C indicates a time width of the detection of the electrostatic capacitance by the electrostatic capacitance sensor 33 in FIG. 11B.

As illustrated in FIG. 11C, the time width K of the detection of the electrostatic capacitance by the electrostatic capacitance sensor 33 when the remaining amount of the toner 28 is small is shorter than the time width J of the detection of the electrostatic capacitance by the electrostatic capacitance sensor 33 when the remaining amount of the toner 28 is large. Therefore, the time of transit by the detected electrode 361 over the detection surface, for which the electrostatic capacitance sensor electrode 321 can detect the electrostatic capacitance, changes according to the remaining amount of the toner 28. This principle can be used to detect the remaining amount of the toner 28.

In the present embodiment, the detection start timing is when the detected electrode 361 closer to the rotation shaft 29 of the detection member 351 reaches over the detection surface of the electrostatic capacitance sensor electrode 321. The detection end timing is when the detected electrode 361 closer to the leading edge in the circumferential direction of the detection member 351 is out of the detection surface. Since the vertical length of the detected electrode 361 is longer, the time that the detected electrode overlaps with the detection surface of the electrostatic capacitance sensor electrode 321 is longer than that of the first embodiment. As a result, the time width of the detection of the detected electrode 361 by the detection surface increases, and the detection accuracy of the remaining amount of the toner 28 can be improved.

Figures 6, 6A:
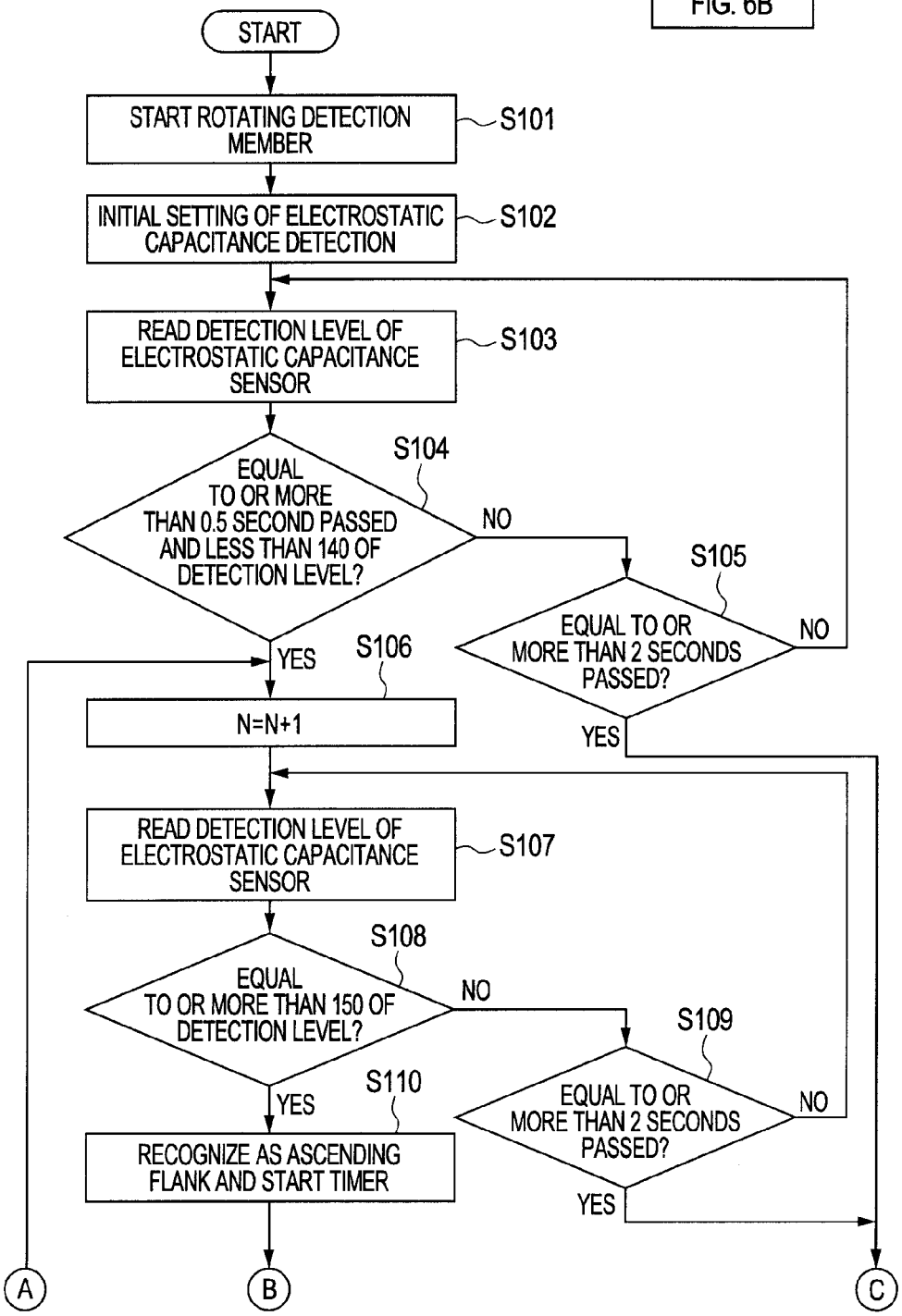
FIG. 6 is comprised of FIGS. 6A and 6B showing flow charts illustrating a processing sequence of toner remaining amount detection of the first embodiment.
Figure 6B:
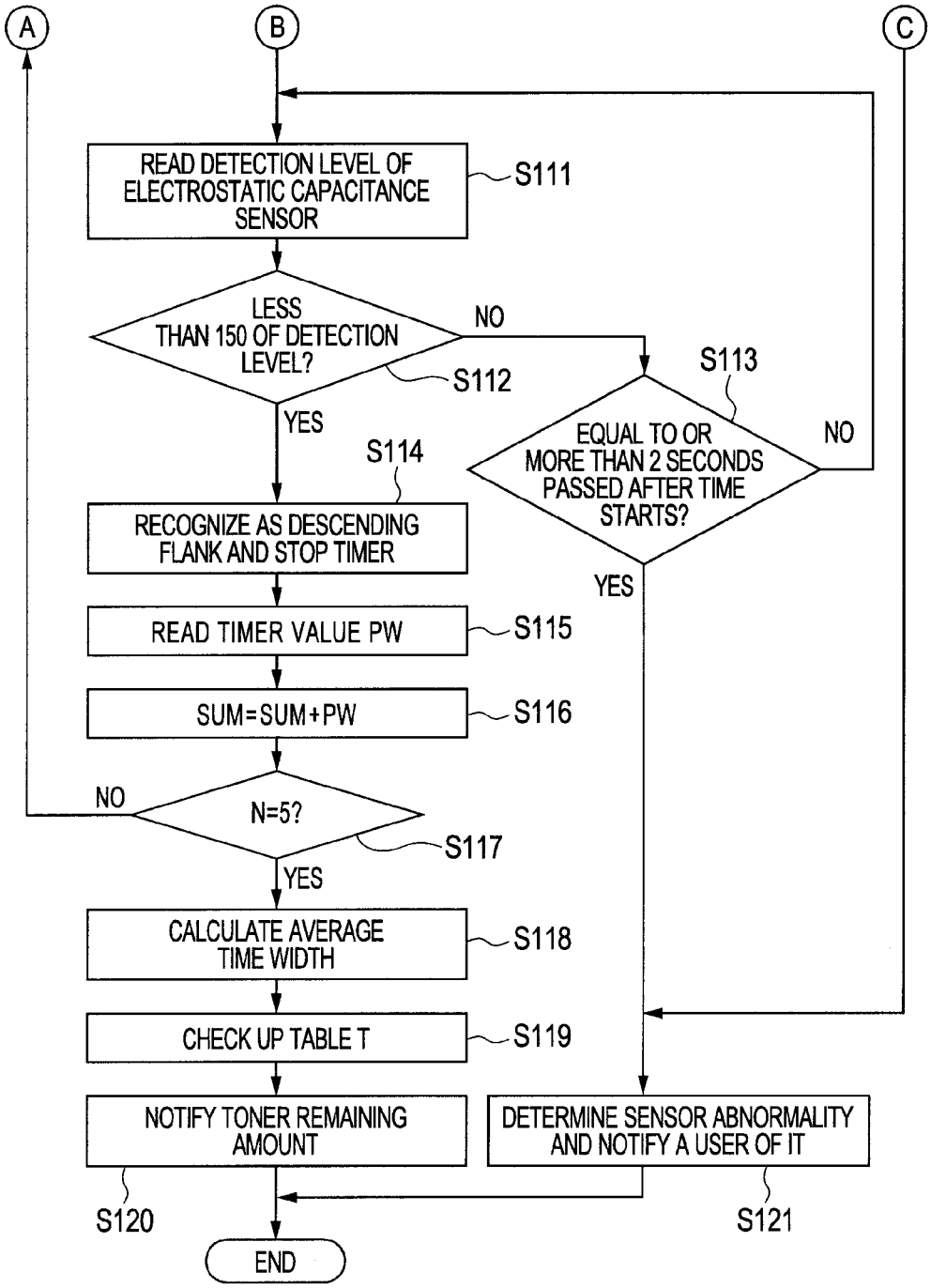

The flow charts of FIGS. 6A and 6B described in the first embodiment can be applied to the processing sequence of the remaining amount detection of the toner according to the present embodiment to calculate the toner remaining amount. Therefore, the processing sequence of the present embodiment will not be described. As for the table indicating the correspondence between the average time width of the detection level and the toner remaining amount, the table T of the first embodiment cannot be used because the configuration of the detected electrode 361 is different between the first and third embodiments. Therefore, the developing unit and the electrostatic capacitance sensor board with the configuration of the present embodiment need to be used to obtain a characteristic graph indicating a relationship between the remaining amount of the toner 28 and the average time width of the detection of the detected electrode 361 by the electrostatic capacitance sensor 33. A new table needs to be created based on the characteristic graph.

As described, according to the present embodiment, the remaining amount can be sequentially detected with a simple configuration, regardless of the amount of the toner. The remaining amount of the toner can be accurately detected even if the agitation member is moving at a high speed. According to the configuration and the operation, the time width of the detection of the detected electrode by the electrostatic capacitance sensor can be measured, and the time width can be checked up in the table to sequentially detect the remaining amount of the toner, from the state in which the toner is full until the toner is empty. The reaction rate of the electrostatic capacitance sensor system is high. Therefore, the acceleration of the detection time and the image formation operation can be performed at the same time. The bend of the detection member is stable in accordance with the remaining amount of the toner even if the detection member is rotating at a high speed. Therefore, the remaining amount of the toner can be sequentially detected.

Fourth Embodiment

The configuration of the image forming apparatus described in the first embodiment is shared in the present embodiment, and the description will not be repeated.

Configurations of Process Cartridge and Developing Unit

Figure 12A:
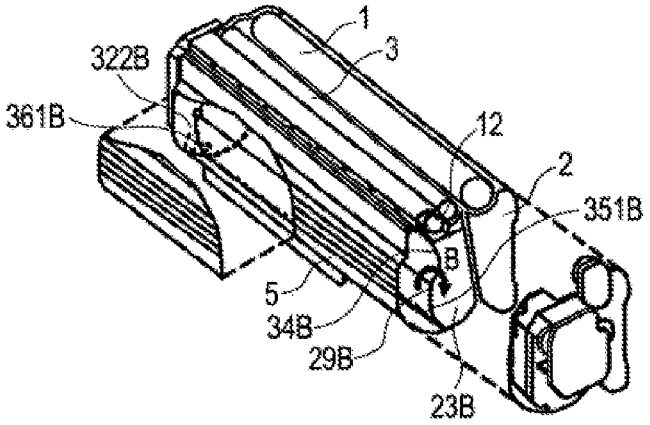
FIGS. 12A, 12B, 12C and 12D are cross-sectional views of the developing unit of the first embodiment.

FIG. 12A is a partial perspective view of the process cartridge 5. A toner container 23B of the process cartridge 5 illustrated in FIG. 12A includes the following. The toner container 23B as the developing unit includes an agitation element 34B that agitates the toner (not illustrated), therein. The thickness of the agitation element 34B is 150 μm and is flexible. The agitation element 34B is provided on a rotation shaft 29B in the toner container 23B, and the agitation element 34B rotates at a speed of about 1 sec/rotation in the arrow B direction. A flexible detection member 351B that detects the toner remaining amount is provided on the rotation shaft 29B. A general-purpose Mylar film is used for the detection member 351B. In the present embodiment, the thickness of the detection member 351B is 75 μm. In the present embodiment, a difference in the amount of bend is realized by changing the thickness of the agitation element 34B and the detection member 351B. Therefore, the detection member 351B is more flexible than the agitation element 34B. As described later, the arrangement is not limited to the present embodiment if the amount of bend of the detection member 351B changes according to the resistance of the toner between when the toner remaining amount is large and when the toner remaining amount is small.

Figure 12B:
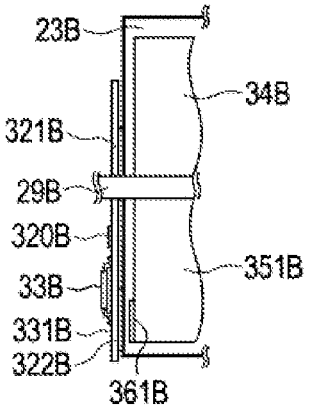

The detection member 351B is provided on the rotation shaft 29B to form a predetermined angle with the agitation element 34B. The predetermined angle can be an angle such that the detection member 351B and the agitation element 34B do not come in contact in the agitation operation of the agitation element 34B. In the present embodiment, the detection member 351B is provided 180 degrees backward in the rotation direction of the agitation element 34B. The angle is not limited to 180° if the arrangement allows the detection of the electrostatic capacitance by the detection member 351B, with the toner being stable on some level after the agitation of the toner by the agitation element 34B. The detection member 351B includes a detected electrode 361B (first electrode) near the leading edge (leading edge section) in the radial direction (hereinafter, also called "circumferential direction") around the rotation shaft 29B. As illustrated in FIG. 12B, the detected electrode 361B is a conductive electrode provided to include a surface parallel to the sidewall of the developing unit, at the edge near the wall of the toner container 23B perpendicular to the rotation shaft 29B in the leading edge section of the detection member 351B. The length in the circumferential direction of the detection member 351B is set to a length that allows the detected electrode 361B to pass over the surface of an electrostatic capacitance sensor electrode F321B and that allows the detected electrode 361B to pass over the surface of an electrostatic capacitance sensor electrode S322B regardless of the amount of the toner. The electrostatic capacitance sensor electrodes F321B and S322B will be described next.

Figure 12C:
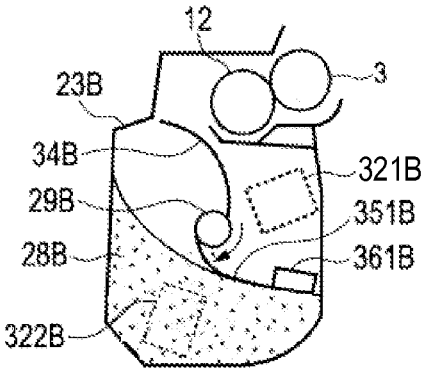
Figure 12D:
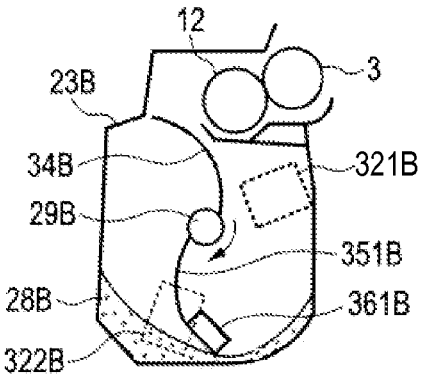

FIG. 12B illustrates a cross-sectional view of part of the developing unit and of an electrostatic capacitance sensor board 33B1 included in the main body 101. An electrostatic capacitance sensor IC33B and peripheral circuit components (not illustrated) of the electrostatic capacitance sensor IC33B are mounted on the electrostatic capacitance sensor board 33B1. In the present embodiment, an electrostatic capacitance sensor IC that uses a difference between the electrostatic capacitance based on the electrostatic capacitance sensor electrode and the electrostatic capacitance based on the reference electrode to detect a change in the electrostatic capacitance based on the electrostatic capacitance sensor electrode will be used in the description. The electrostatic capacitance sensor electrode F321B (second electrode), the electrostatic capacitance sensor electrode S322B (third electrode), and a reference electrode 320B are formed in copper foil patterns on the electrostatic capacitance sensor board 33B1. As illustrated in FIGS. 12B to 12D, the electrostatic capacitance sensor electrode F321B is provided so that the detected electrode 361B can pass over the detection surface of the electrostatic capacitance sensor electrode F321B at a position not affected by the resistance of the toner even if the toner is full. Meanwhile, the electrostatic capacitance sensor electrode S322B is provided so that the detected electrode 361B can pass over the detection surface of the electrostatic capacitance sensor electrode S322B at a position affected by the resistance of the toner even if the amount of the toner is small.

The outer side of the developing unit (outer surface of the developing unit and one of the surfaces perpendicular to the rotation shaft 29B) approaches the electrostatic capacitance sensor electrode F321B and the electrostatic capacitance sensor electrode S322B when the process cartridge 5 is mounted on the main body 101. In this way, the electrostatic capacitance sensor electrode F321B and the electrostatic capacitance sensor electrode S322B are provided near the outer surface of the developing unit, specifically, near the side that is a wall of the developing unit perpendicular to the rotation shaft 29B. In this state, the electrostatic capacitance sensor IC33B detects a change in the electrostatic capacitance generated when the detected electrode 361B provided on the detection member 351B approaches the electrostatic capacitance sensor electrode F321B. Similarly, the electrostatic capacitance sensor IC33B detects a change in the electrostatic capacitance generated when the detected electrode 361B provided on the detection member 351B approaches the electrostatic capacitance sensor electrode S322B.

FIGS. 12C and 12D are cross-sectional views of the developing unit illustrated in FIG. 12A. FIG. 12C illustrates a state in which the toner remaining amount is about 50%, and FIG. 12D illustrates a state in which the toner remaining amount is about 10%. As illustrated in FIG. 12C, when the detection member 351B makes a rotational movement, the detection member 351B is affected by the resistance of the toner 28B if the toner remaining amount is large. The detection member 351B is transformed backward in the rotation direction and makes a rotational move while being bent. In this case, the detection member 351B is largely transformed backward in the rotation direction. In this state, the length from a time (first time) when the detected electrode 361B provided on the detection member 351B reaches over the detection surface of the electrostatic capacitance sensor electrode F321B to a time (second time) when the detected electrode 361B reaches over the detection surface of the electrostatic capacitance sensor electrode S322B is long. Meanwhile, as illustrated in FIG. 12D, the amount of bend of the detection member 351B is reduced if the toner remaining amount is small. As a result, the length from the time (first time) when the detected electrode 361B provided on the detection member 351B reaches over the detection surface of the electrostatic capacitance sensor electrode F321B to the time (second time) when the detected electrode 361B reaches over the detection surface of the electrostatic capacitance sensor electrode S322B is short. As described, the electrostatic capacitance sensor electrode F321B is provided at a position not affected by the resistance of the toner even if the toner is full. Therefore, this can be a standard of the measurement of the time difference regardless of the amount of the toner. This principle is used in the present embodiment to detect the toner remaining amount.

Circuit Configuration of Electrostatic Capacitance Sensor IC

Figure 13:
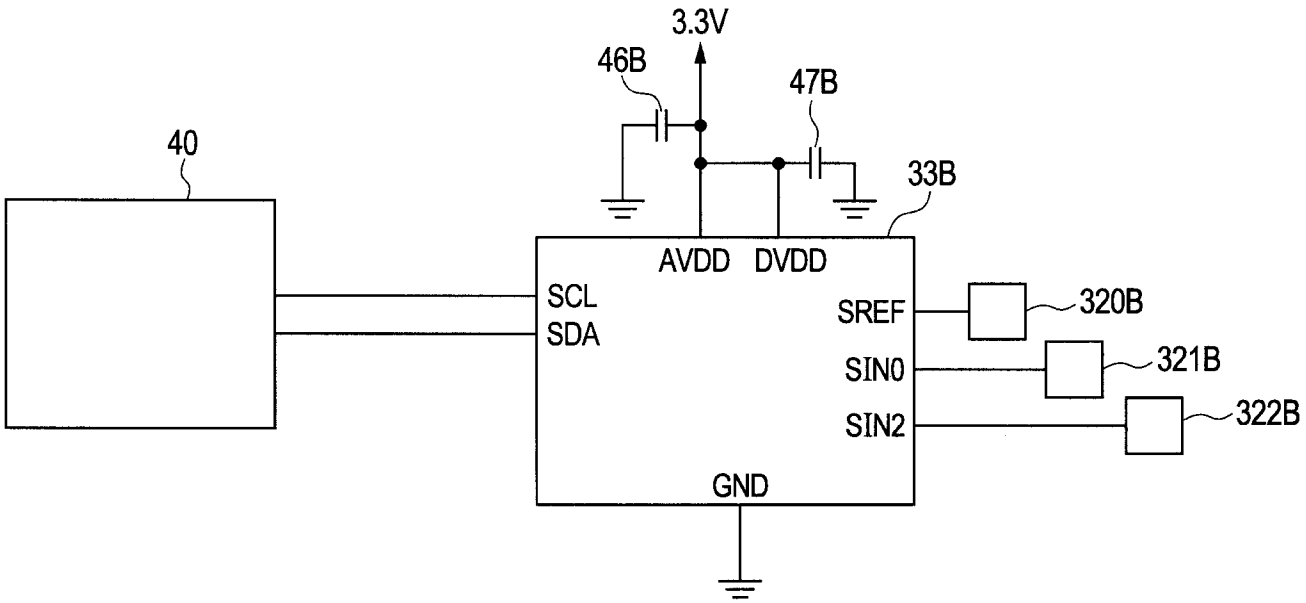
FIG. 13 is a circuit diagram around an electrostatic capacitance sensor IC of the first and second embodiments.

FIG. 13 is a diagram illustrating a connection relationship between the electrostatic capacitance sensor IC33B, the CPU 40, the reference electrode 320B, the electrostatic capacitance sensor electrode F321B, and the electrostatic capacitance sensor electrode S322B of the present embodiment. A bypass capacitor 46B removes noise of the analog power terminal AVDD of the electrostatic capacitance sensor IC33B. A bypass capacitor 47B removes noise of the digital power terminal DVDD of the electrostatic capacitance sensor IC33B. The reference electrode 320B is connected to the SREF terminal. The electrostatic capacitance sensor electrode F321B is connected to an SIN0 terminal. The electrostatic capacitance sensor electrode S322B is connected to an SIN2 terminal. The reference electrode 320B, the electrostatic capacitance sensor electrode F321B, and the electrostatic capacitance sensor electrode S322B have the same area and have copper foil patterns. The electrostatic capacitance sensor IC33B performs communication through serial communication lines (SCL, SDA) to transmit level data corresponding to the detected value of the electrostatic capacitance to the CPU 40.

Characteristics of Toner Remaining Amount Detection

Characteristics of the toner remaining amount detection according to the present embodiment will be described with reference to FIGS. 14A to 14C. FIG. 14A illustrates a characteristic graph of the toner remaining amount detection of the present embodiment, and the horizontal axis denotes the toner remaining amount (%). The vertical axis of the graph of FIG. 14A denotes a time difference (hereinafter, described as "time difference D") (milliseconds (msec)) from the time that the detected electrode 361B provided on the detection member 351B reaches over the detection surface of the electrostatic capacitance sensor electrode F321B until the detected electrode 361B reaches over the detection surface of the electrostatic capacitance sensor electrode S322B. FIG. 14B illustrates waveform data of the detection level of the electrostatic capacitance sensor IC33B when the detected electrode 361B is detected by the electrostatic capacitance sensor electrode S322B. The time difference D is 403 milliseconds when the toner remaining amount is 25.0% (solid line of FIG. 14B). The time difference D is 423 milliseconds when the toner remaining amount is 66.7% (dotted line of FIG. 14B). The time difference D is 443 milliseconds when the toner remaining amount is 83.3% (broken line of FIG. 14B). Although the waveform data of the detection level of the electrostatic capacitance sensor IC33B when the electrostatic capacitance sensor electrode F321B detects the detected electrode 361B is not illustrated, the peak of the waveform is the same time regardless of the toner remaining amount.

FIG. 14C illustrates a table T. For example, if the time difference D from the detection of the detected electrode 361B by the electrostatic capacitance sensor electrode F321B to the detection of the detected electrode 361B by the electrostatic capacitance sensor electrode S322B is 423B milliseconds, it can be recognized that the remaining amount of the toner is 66.7% with reference to the table T. The toner remaining amount between the numerical values described in the table T is calculated by known linear interpolation. Since the calculated detection level is a value in the present embodiment, the calculated detection level changes if the conditions change. The same applies to the numerical values of the table T for calculating the toner remaining amount.

It is only necessary that the electrostatic capacitance sensor IC33B and the peripheral circuits can detect the electrostatic capacitance, and analog integrated circuits can be used instead. In the present embodiment, the electrostatic capacitance sensor electrode F321B and the electrostatic capacitance sensor electrode S322B are formed on the electrostatic capacitance sensor board 33B1 included in the main body 101. However, it is only necessary that the electrostatic capacitance sensor electrode F321B and the electrostatic capacitance sensor electrode S322B be provided near the wall (neighborhood of the wall) of the developing unit. For example, the electrostatic capacitance sensor electrode F321B and the electrostatic capacitance sensor electrode S322B may be directly formed on the developing unit wall. In that case, electrical contacts can be provided between the electrostatic capacitance sensor board 33B1, the electrostatic capacitance sensor electrode F321B, and the electrostatic capacitance sensor electrode S322B, and connections can be made when the process cartridge 5 is mounted on the main body 101.

Toner Remaining Amount Detection Process

Figures 15, 15A:
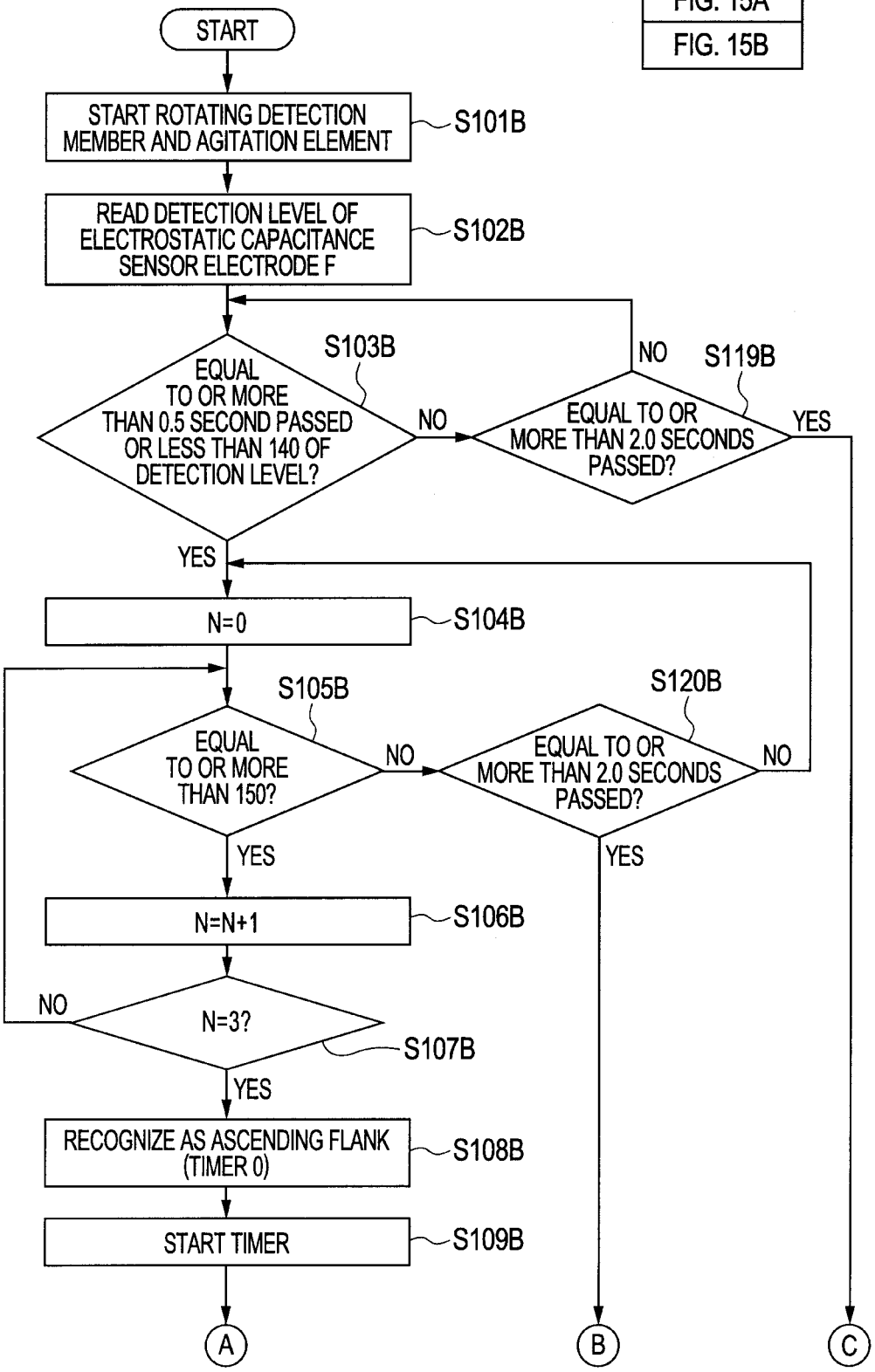
FIG. 15 is comprised of FIGS. 15A and 15B showing flow charts describing a toner remaining amount detection process of the first and second embodiments.
Figure 15B:
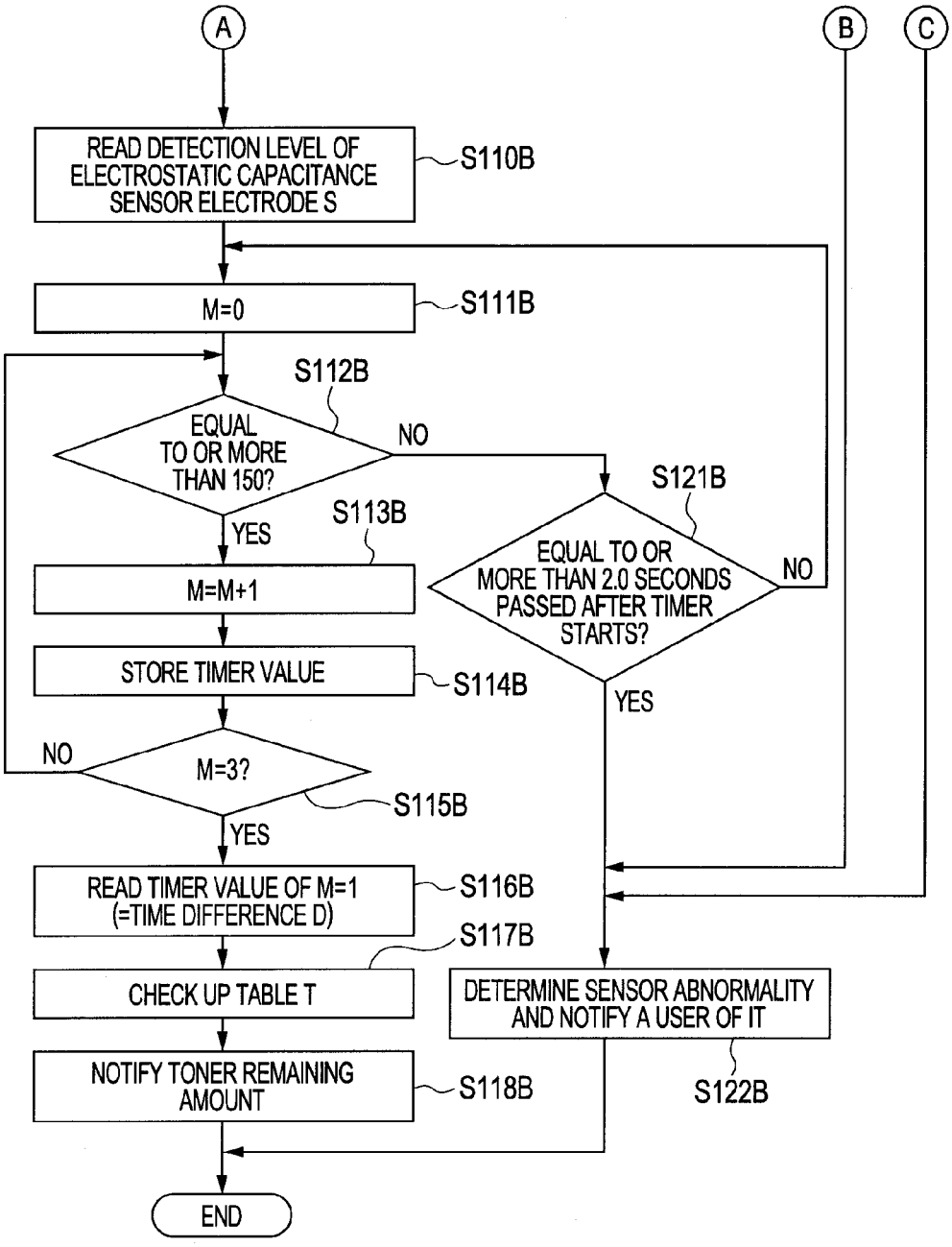

A toner remaining amount detection process of the present embodiment will be described with reference to flow charts of FIGS. 15A and 15B. As in flow charts of the following embodiments, the CPU 40 executes the processes of the flows. However, the arrangement is not limited to this, and if an integrated circuit (ASIC) for characteristics is mounted on the image forming apparatus, the integrated circuit may have functions of some of the steps.

In S101B, the CPU 40 starts the rotation of the agitation element 34B and the detection member 351B. In S102B, the CPU 40 performs serial communication with the electrostatic capacitance sensor IC33B to set initial values and starts reading the detection level of the electrostatic capacitance sensor electrode F321B. The CPU 40 starts a timer not illustrated to be referenced in S103B, S119B, and S120B described later. In S103B, the CPU 40 refers to the timer not illustrated to determine whether the time that the detection level read by the electrostatic capacitance sensor IC33B is equal to or less than 140 continues for equal to or more than 0.5 second. If the CPU 40 determines that the detection level is equal to or less than 140 for equal to or more than 0.5 second in S103B, the CPU 40 determines that the detection level is in the initial state in which the detected electrode 361B has not yet reached over the detection surface of the electrostatic capacitance sensor electrode F321B. In S104B, the CPU 40 resets a counter N (N=0) that removes sudden noise of the ascending flank of the electrostatic capacitance sensor electrode F321B.

In S105B, the CPU 40 determines whether the detection level of the electrostatic capacitance sensor IC33B is equal to or more than 150. If the CPU 40 determines that the detection level of the electrostatic capacitance sensor IC33B is equal to or more than 150 in S105B, the CPU 40 detects that there is an ascending flank of the signal of the electrostatic capacitance sensor IC33B and adds 1 to the counter N in S106B. In S107B, the CPU 40 determines whether there is sudden noise. The value of the detection level 150 is a so-called ascending flank threshold. In S107B, the CPU 40 determines whether the value of the counter N is, for example, 3. If the value of the counter N is a value smaller than 3, the CPU 40 determines that there is sudden noise in S107B and returns to the process of S105B. Meanwhile, if the CPU 40 determines that the counter N indicates 3 in S107B, in other words, if the process from S105B to S107B is repeated three consecutive times, the CPU 40 recognizes that there is an ascending flank of a correct signal in S108B. In S108B, the CPU 40 resets the timer for measuring the time difference D. In S109B, the CPU 40 starts the timer for measuring the time difference D.

In S110B, the CPU 40 starts reading the detection level of the electrostatic capacitance sensor electrode S322B. In S111B, as in the process applied to the electrostatic capacitance sensor electrode F321B, the CPU 40 resets a counter M (M=0) for removing sudden noise of the ascending flank of the electrostatic capacitance sensor electrode S322B. In S112B, the CPU 40 determines whether the detection level detected by the electrostatic capacitance sensor IC33B based on the electrostatic capacitance sensor electrode S322B is equal to or more than 150. If the CPU 40 determines that the detection level of the electrostatic capacitance sensor IC33B is equal to or more than 150 in S112B, the CPU 40 detects that there is an ascending flank of the signal of the electrostatic capacitance sensor IC33B and starts determining whether the signal indicates sudden noise. In S113B, the CPU 40 adds 1 to the counter M. In S114B, the CPU 40 stores the value of the counter M and the value of the timer measuring the time difference D corresponding to the value of the counter M in a memory not illustrated. In S115B, the CPU 40 determines whether the value of the counter M indicates, for example, 3. If the CPU 40 determines that the counter M indicates 3 in S115B, in other words, if the process from S112B to S115B is repeated three consecutive times, the CPU 40 recognizes that there is an ascending flank of a correct signal in S116B. In S116B, the CPU 40 also reads, from the memory, the value of the timer that has measured the time difference D stored in the memory in S114B when M is 1. In S117B, the CPU 40 checks up the table T to detect the toner remaining amount from the time difference D. In S118B, the CPU 40 notifies the video controller 42 of the toner remaining amount obtained as a result of checking up the table T in S117B. It is only necessary that the values used in S107B and S115B can remove the sudden noise, and values that prevent a correct signal from being falsely detected as sudden noise can be set. The values are not limited to the values of the present embodiment.

The period of the detection member 351B is about one second in the present embodiment. Therefore, if the CPU 40 determines that the detection level is not equal to or less than 140 for equal to or more than 0.5 second in S103B, the CPU 40 determines whether equal to or more than 2.0 seconds have passed in S119B. If the CPU 40 determines that equal to or more than 2.0 seconds have not passed in S119B, the CPU 40 returns to the process of S103B. If the CPU 40 determines that equal to or more than 2.0 seconds have passed, the CPU 40 proceeds to a process of S122B. Such a state is a state in which the electrostatic capacitance sensor IC33B is failed or the detected electrode 361B remains in the detection position of the electrostatic capacitance sensor electrode F321B, or is a state of a communication abnormality between the CPU 40 and the electrostatic capacitance sensor IC33B. Therefore, in S122B, the CPU 40 determines that there is one of the abnormalities and notifies the video controller 42 of the abnormality.

If the CPU 40 determines that the detection level of the electrostatic capacitance sensor IC33B is less than 150 in S105B, the CPU 40 proceeds to a process of S120B. In S120B, the CPU 40 determines whether equal to or more than 2.0 seconds have passed in that state. If the CPU 40 determines that equal to or more than 2.0 seconds have not passed in S120B, the CPU 40 returns to the process of S104B. If the CPU 40 determines that equal to or more than 2.0 seconds have passed in S120B, the electrostatic capacitance sensor IC33B cannot detect the detected electrode 361B. Therefore, the CPU 40 determines that there is an abnormality in S122B and notifies the video controller 42 of the abnormality. If the CPU 40 determines that the detection level for detecting the electrostatic capacitance sensor electrode S322B of the electrostatic capacitance sensor IC33B is less than 150 in S112B, the CPU 40 determines in S121B whether equal to or more than 2.0 seconds have passed based on the timer started in S109B. If the CPU 40 determines that equal to or more than 2.0 seconds have not passed in S121B, the CPU 40 returns to the process of S111B. If the CPU 40 determines that equal to or more than 2.0 seconds have passed after the start of the timer in S121B, the CPU 40 proceeds to the process of S122B. Such a state is a state in which the detected electrode 361B is staying at the detection position of the electrostatic capacitance sensor electrode S322B or a state of an abnormality of the electrostatic capacitance sensor IC33B. Therefore, in S122B, the CPU 40 determines that there is one of the abnormalities and notifies the video controller 42 of the abnormality. In this way, the process of S119B, S120B, and S121B can determine whether the electrostatic capacitance sensor IC33B is in an abnormal state, such as a failure.

In this way, the CPU 40 measures the time difference D of the detection of the detected electrode 361B by the electrostatic capacitance sensor IC33B based on the electrostatic capacitance sensor electrode F321B or the electrostatic capacitance sensor electrode S322B and checks up the table T to sequentially detect the toner remaining amount. An example of measuring the time difference based on the absolute value of the detection level has been illustrated in the sequence of the present embodiment. However, a stable initial level can be detected, and the initial level plus something extra can be set as a threshold. The time difference D can be measured to check up the time difference D in the table T. Such a sequence can also be applied. Although an example of the ascending flank of the detection level has been illustrated in the present embodiment, a descending flank of one of the signals may be combined to measure the time difference.

According to the present embodiment, the configuration and the operation have the following advantageous effects. The time difference of the detection of the detected electrode from 100% to 0% of the toner remaining amount monotonically increases, and sequential detection of the remaining amount can be performed from when the toner is full until the toner is empty. The reaction rate of the electrostatic capacitance sensor system is high. Therefore, the acceleration of the detection time and the image formation operation can be performed at the same time. The bend of the detection member is stable in accordance with the remaining amount of the toner even if the detection member is rotating at a high speed. Therefore, the toner remaining amount can be sequentially detected. According to the present embodiment, the remaining amount of the toner can be sequentially detected from when the toner is full until the toner is empty. The remaining amount of the toner can be accurately detected even if the agitation member is moving at a high speed.

Fifth Embodiment

An example of arranging the electrostatic capacitance sensor board 33B1 on the sidewall of the toner container as a surface perpendicular to the axial direction of the rotation shaft 29B of the agitation element 34B and the detection member 351B is illustrated in the fourth embodiment. Meanwhile, an example of arranging the electrostatic capacitance sensor board 33B1 in the circumferential direction of the rotation shaft 29B of the agitation element 34B and the detection member 351B, i.e. an example of arranging the electrostatic capacitance sensor board 33B1 on the surface perpendicular to the radial direction of the rotation of the rotation shaft 29B, will be illustrated in the fifth embodiment. The configurations and the descriptions of FIGS. 1, 13, 14A to 14C, and 15A and 15B mentioned in the first and second embodiments are also applied to this embodiment. The same configurations as those in the fourth embodiment are designated with the same reference numerals, and the detailed description will not be repeated.

Configuration of Developing Unit

Figure 16A:
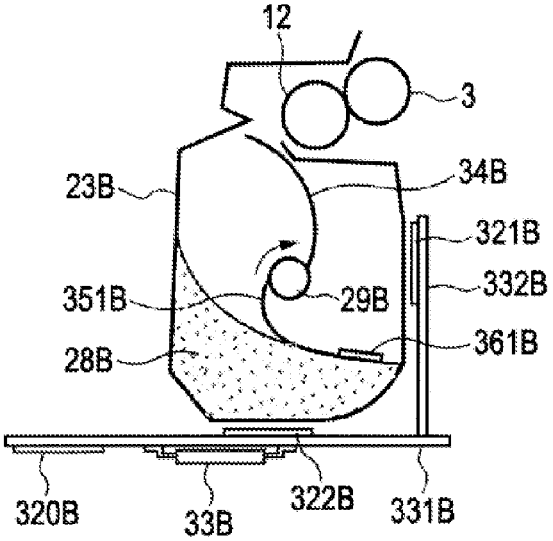
FIGS. 16A, 16B, and 16C are cross-sectional views of the developing unit of the second embodiment.
Figure 16B:
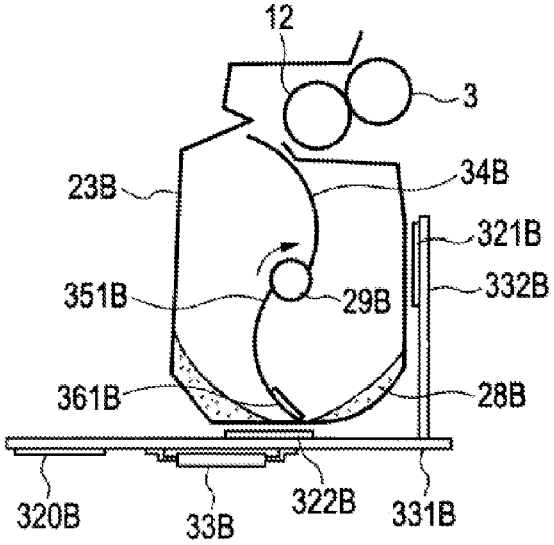

FIGS. 16A and 16B are cross-sectional views of the developing unit according to the present embodiment. FIG. 16A illustrates a state in which the toner remaining amount is about 50%. FIG. 16B illustrates a state in which the toner remaining amount is about 10%. An electrostatic capacitance electrode board 33B2 is connected to the electrostatic capacitance sensor board 33B1 through a connector not illustrated. The electrostatic capacitance sensor electrode F321B and the electrostatic capacitance sensor electrode S322B are provided in the circumferential direction of the rotation of the detected electrode 361B. In the present embodiment, for example, the electrostatic capacitance sensor electrode F321B is provided on the side of the developing unit parallel to the rotation shaft 29B, and the electrostatic capacitance sensor electrode S322B is provided on the bottom of the developing unit. In the present embodiment, the electrostatic capacitance sensor electrode F321B is provided so that the detected electrode 361B can pass over the detection surface of the electrostatic capacitance sensor electrode F321B at a position not affected by the resistance of the toner even if the toner is full. Meanwhile, the electrostatic capacitance sensor electrode S322B is provided so that the detected electrode 361B can pass over the detection surface of the electrostatic capacitance sensor electrode S322B at a position affected by the resistance of the toner even if the amount of the toner is small.

Figure 16C:
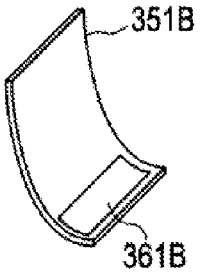

FIG. 16C is a perspective view indicating a positional relationship between the detection member 351B and the detected electrode 361B. The length in the axial direction of the detection member 351B and the detected electrode 361B can be a length that allows passing over at least the detection surfaces of the electrostatic capacitance sensor electrode F321B and the electrostatic capacitance sensor electrode S322B detected by the electrostatic capacitance sensor IC33B.

According to the present embodiment, the configuration and the operation have the following advantageous effects. The reaction rate of the electrostatic capacitance sensor system is high, and the acceleration of the detection time and the image formation operation can be performed at the same time. The bend of the agitation element is stable according to the toner remaining amount even if the agitation element rotates at a high speed, and therefore, the toner remaining amount can be detected. A combination of the case of arranging the electrostatic capacitance sensor electrode in the axial direction of the rotation shaft of the agitation element and the case of arranging the electrostatic capacitance sensor electrode in the circumferential direction of the rotation shaft of the agitation element as illustrated in the first embodiment can handle configurations of various process cartridges. The table T is referenced in one measurement of the time difference D to facilitate the understanding in the description in the first and second embodiments. However, if it is controlled to average a plurality of data to reference the tables T, the detection accuracy can be further improved. An example of an integrated configuration of the developing unit is illustrated in the first and second embodiments. However, the arrangement of the detected electrode and the detection member in the toner container allows applying the present invention to a toner container of a supply system including separate developing roller and toner container. The detection member may have a function of agitating the toner.

According to the present embodiment, the remaining amount of the toner can be sequentially detected from when the toner is full until the toner is empty, and the remaining amount of the toner can be accurately detected even if the agitation member is moving at a high speed.

Sixth Embodiment

The configuration of the image forming apparatus described in the first embodiment can be shared in the present embodiment, and the description will not be repeated.

Configurations of Developing Unit and Electrostatic Capacitance Sensor Board

Figure 17A:
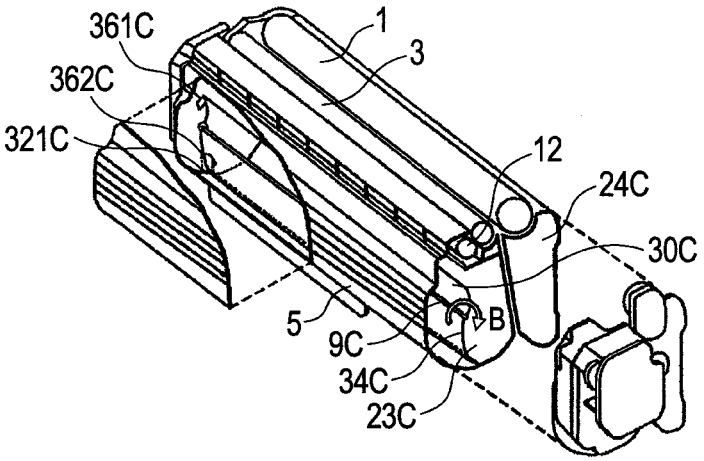
FIGS. 17A, 17B, and 17C are configuration diagrams of the developing unit and the electrostatic capacitance sensor board of sixth and second embodiments.

Configurations of the developing unit and the electrostatic capacitance sensor board forming the process cartridge will be described with reference to FIGS. 17A to 17C. The developing unit of the process cartridge 5 illustrated in FIG. 17A includes the following. Provided is a flexible agitation element 34C (second member) that agitates the toner (not illustrated) in a toner container 23C and that detects the toner remaining amount. Also provided is a reference member 30C (first member) that is shorter in the radial direction (direction perpendicular to a rotation shaft 29C) than the agitation element 34C. The length of the agitation element 34C in the direction of the rotation shaft 29C (longitudinal direction) is about the same length as the rotation shaft 29C as illustrated in FIG. 17A, and the length in the radial direction is about a length that causes the agitation element 34C to slide the bottom of the toner container 23C. The length of the reference member 30C in the direction of the rotation shaft 29C (longitudinal direction) may be about the same length as the rotation shaft 29C or may be about a length that allows setting a detected electrode 362C described next. The length of the reference member 30C in the radial direction needs to be a length shorter than the agitation element 34C as described above and a length that does not cause the reference member 30C to rub the bottom of the toner container 23C. General-purpose Mylar films are used for the agitation element 34C and the reference member 30C. The thickness of the reference member 30C is 150 μm, and the thickness of the agitation element 34C is 75 μm. Therefore, the amount of curvature of the agitation element 34C is larger than that of the reference member 30C. The reference member 30C and the agitation element 34C are provided on the rotation shaft 29C in the toner container 23C, and the phase is shifted by an angle of 180 degrees. The reference member 30C and the agitation element 34C rotate (move around) in the arrow B direction at a rotation speed of one rotation in about one second (sec). The reference member 30C includes a conductive detected electrode 361C (first electrode) near the leading edge and at the edge near the wall of the toner container 23C. Similarly, the agitation element 34C includes the conductive detected electrode 362C (second electrode) near the leading edge and at the edge near the wall of the toner container 23C. The length in the radial direction of the reference member 30C is shorter than that of the agitation element 34C. Therefore, the detected electrode 361C is provided closer to the rotation shaft 29C than the detected electrode 362C.

Figure 17B:
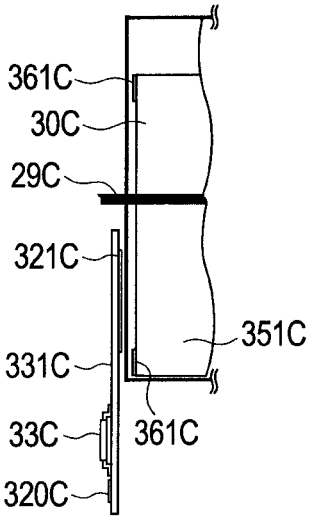
Figure 17C:
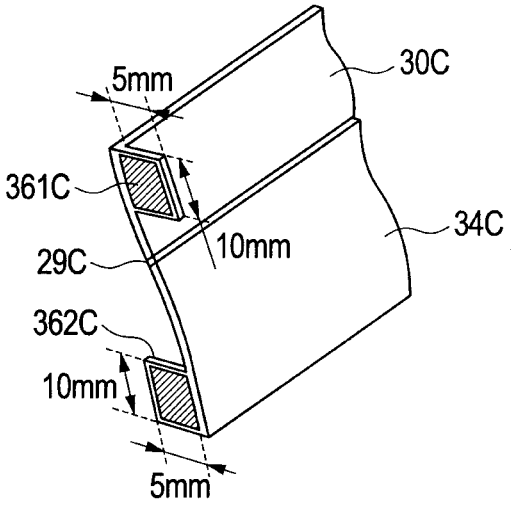

FIG. 17B illustrates a cross-sectional view of part of the developing unit and of an electrostatic capacitance sensor board 331C. The electrostatic capacitance sensor board 331C includes an electrostatic capacitance sensor IC33C and peripheral circuit components (not illustrated) of the electrostatic capacitance sensor IC33C. An electrostatic capacitance sensor electrode 321C (third electrode) and a reference electrode 320C are formed in copper foil patterns on the electrostatic capacitance sensor board 331C. The reference electrode 320C and the electrostatic capacitance sensor electrode 321C are in copper foil patterns with the same area. In the present embodiment, the electrostatic capacitance sensor IC33C that uses a difference between the electrostatic capacitance based on the electrostatic capacitance sensor electrode 321C and the electrostatic capacitance based on the reference electrode 320C to detect a change in the electrostatic capacitance is used. The outer side of the developing unit approaches the electrostatic capacitance sensor electrode 321C so as to form a positional relationship illustrated in FIG. 17B when the process cartridge 5 is mounted on the main body 101. In this state, the electrostatic capacitance sensor IC33C detects the change in the electrostatic capacitance generated when the detected electrode 361C provided on the reference member 30C approaches the electrostatic capacitance sensor electrode 321C. Similarly, the electrostatic capacitance sensor IC33C detects the change in the electrostatic capacitance generated when the detected electrode 362C provided on the agitation element 34C approaches the electrostatic capacitance sensor electrode 321C. FIG. 17C is a perspective view indicating a positional relationship between the reference member 30C, the detected electrode 361C, the agitation element 34C, and the detected electrode 362C. The shape of the detected electrode 361C and the detected electrode 362C is a rectangle 10 mm long and 5 mm wide. The electrode surface of the detected electrode 361C approaches the electrostatic capacitance sensor electrode 321C when the reference member 30C faces downward in the direction of the gravitational force. The electrode surface of the detected electrode 362C approaches the electrostatic capacitance sensor electrode 321C when the agitation element 34C faces downward in the direction of the gravitational force.

It is only necessary that the electrostatic capacitance sensor IC33C and the peripheral circuits can detect the electrostatic capacitance, and analog integrated circuits can also be used instead. In the present embodiment, the electrostatic capacitance sensor electrode 321C is formed on the electrostatic capacitance sensor board 331C provided on the main body 101. However, it is only necessary that the electrostatic capacitance sensor electrode 321C be near the wall of the developing unit, and for example, the electrostatic capacitance sensor electrode 321C can be directly formed on the developing unit wall. In that case, electrical contacts can be provided on the electrostatic capacitance sensor board 331C and the electrostatic capacitance sensor electrode 321C, and the contacts can be connected when the process cartridge 5 is mounted on the main body 101.

Circuit Diagram of Toner Remaining Amount Detection

Figure 18A:
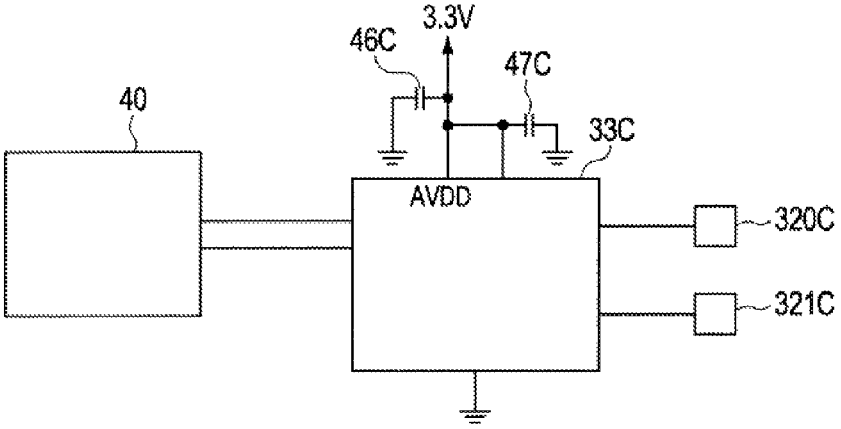
FIGS. 18A, 18B, and 18C are a circuit diagram of the toner remaining amount detection and cross-sectional views of the developing unit of the sixth and second embodiments.

FIG. 18A is a circuit diagram of the toner remaining amount detection according to the present embodiment. A bypass capacitor 46C removes noise of the analog power terminal AVDD of the electrostatic capacitance sensor IC33C. A bypass capacitor 47C removes noise of the digital power terminal DVDD of the electrostatic capacitor sensor IC33C. The reference electrode 320C is connected to the SREF terminal, and the electrostatic capacitance sensor electrode 321C is connected to the SIN terminal. The electrostatic capacitance sensor IC33C transmits and outputs 8-bit level data (information) corresponding to the value of the detected electrostatic capacitance to the CPU 40 through the serial communication lines (SCL, SDA). A detailed principle of operation will not be described.

Sequence of Toner Remaining Amount Detection

Figure 18B:
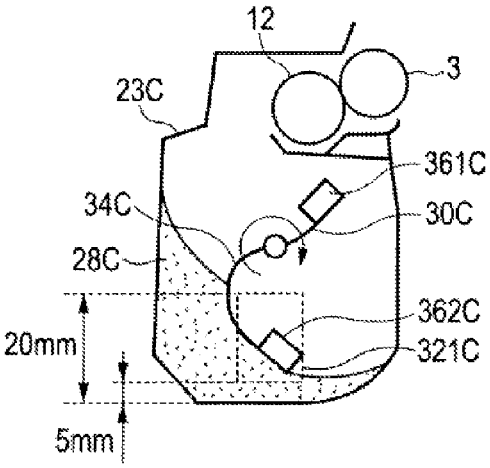
Figure 18C:
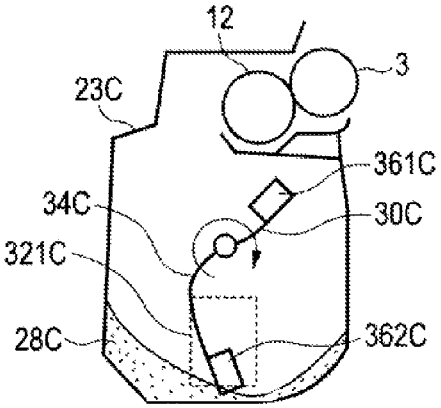

FIGS. 18B and 18C are cross-sectional views of the developing unit in the process cartridge 5. FIG. 18B illustrates a case in which the toner remaining amount is relatively large. FIG. 18C illustrates a case in which the toner remaining amount is small. Movements of the reference member 30C and the agitation element 34C when the toner remaining amount is relatively large and when the toner remaining amount is relatively small will be described with reference to FIGS. 18B and 18C. As illustrated in FIG. 18B, if the toner remaining amount is relatively large, the curvature caused by the resistance of the toner is large because the agitation element 34C is more flexible, and the agitation element 34C is largely transformed backward in the rotation direction. On the other hand, the curvature caused by the resistance of the toner is small because the reference member 30C is less flexible, and the reference member 30C is not largely transformed backward in the rotation direction. Therefore, the time from the arrival of the detected electrode 361C to the detection surface of the electrostatic capacitance sensor electrode 321C to the arrival of the detected electrode 362C to the detection surface of the electrostatic capacitance sensor electrode 321C is long. Meanwhile, if the toner remaining amount is small, the amount of curvature of the agitation element 34C is smaller than when the toner remaining amount is large as illustrated in FIG. 18C. Therefore, the time from the arrival of the detected electrode 361C to the detection surface of the electrostatic capacitance sensor electrode 321C to the arrival of the detected electrode 362C to the detection surface of the electrostatic capacitance sensor electrode 321C is short. This principle is used to detect the toner remaining amount.

Toner Remaining Amount Detection Characteristics

Toner remaining amount detection characteristics according to the present embodiment will be described with reference to FIGS. 19A to 19C. In the present embodiment, the detection level (8-bit level data) of the electrostatic capacitance sensor IC33C is expressed in decimal (dec) in the description. FIG. 19A illustrates a characteristic graph of the toner remaining amount (%) and the time difference (milliseconds (msec)) between the start of detection of the detected electrode 361C of the reference member 30C detected by the electrostatic capacitance sensor IC33C and the start of detection of the detected electrode 362C of the agitation element 34C. FIG. 19B illustrates waveform data of the detection level when the toner remaining amount is 90%. In the waveform data, the first peak waveform is formed by the detected electrode 361C of the reference member 30C, and the next peak waveform is formed by the detected electrode 362C of the agitation element 34C. It can be recognized from the waveform data that the time difference between the start of detection of the detected electrode 361C of the reference member 30C and the start of detection of the detected electrode 362C of the agitation element 34C is 583 msec. The reason that the detection level based on the detected electrode 361C of the reference member 30C is greater than the detection level based on the detected electrode 362C of the agitation element 34C is that the reference member 30C is formed by a material thicker than the agitation element 34C. More specifically, the reference member 30C is more elastic than the agitation element 34C, and the detected electrode 361C is more strongly pressed against the wall of the toner container 23C than the detected electrode 362C. Therefore, the toner 28C does not enter between the detected electrode 361C and the wall of the toner container 23C. As a result, the interval between the detected electrode 361C and the electrostatic capacitance sensor electrode 321C is small, and the detection level is large. Meanwhile, the agitation element 34C is less elastic, and the toner 28C enters between the detected electrode 362C and the wall of the toner container 23C. As a result, the interval between the detected electrode 361C and the electrostatic capacitance sensor electrode 321C is large, and the detection level is small. FIG. 19C is a table T illustrating a relationship between the time difference (msec) and the toner remaining amount (%). The toner remaining amount between the numerical values in the table is obtained by linear interpolation of known toner remaining amounts. The calculated time is a value in the present embodiment. Therefore, the calculated time changes if the conditions change. The same applies to the numerical values of the table T for determining the toner remaining amount. The table T is stored in the storage unit.

Flow Chart of Toner Remaining Amount Detection

Toner remaining amount detection according to the present embodiment will be described with reference to flow charts of FIGS. 20A and 20B. Like the flow charts in the following embodiments, the CPU 40 executes the processes of the flows. However, the arrangement is not limited to this. For example, if an integrated circuit (ASIC) for characteristics is mounted on the image forming apparatus, functions of some of the steps may be included in the integrated circuit. In the process from S108C to S115C of the flow chart, a timer A measures the time from an ascending flank in the waveform data illustrated in FIG. 19B to the next ascending flank. In the process from S116C to S123C, a timer B measures the time until the still next ascending flank.

In the step S101C (hereinafter each step is identified only by the numeral in FIGS. 20A and 20B), the CPU 40 rotates the reference member 30C and the agitation element 34C. In S102C, the CPU 40 performs serial communication with the electrostatic capacitance sensor IC33C to set initial values and starts reading the detection level of the electrostatic capacitance sensor IC33C. In S103C, if the CPU 40 determines that the detection level is less than 140 for equal to or more than 0.2 second, the CPU 40 determines that the detection level is in an initial state in which the detected electrode 361C or the detected electrode 362C is not over the detection surface of the electrostatic capacitance sensor electrode 321C and proceeds to a process of S106C. If the CPU 40 determines that the detection level is not less than 140 for equal to or more than 0.2 second in S103C and determines that equal to or more than 2.0 seconds have passed in S104C, the CPU 40 determines in S105C that there is an abnormality and notifies the video controller 42 of the abnormality. If the CPU 40 determines that equal to or more than 2.0 seconds have not passed in S104C, the CPU 40 continues the process of S103C. If the CPU 40 determines that the detection level is equal to or more than 150 in S106C, the CPU 40 determines that there is an ascending flank of the sensor signal in S108C and sets the timer A to 0. The detection level 150 is a so-called ascending flank threshold. If the CPU 40 determines that the detection level is over the ascending flank threshold, the CPU 40 determines that the detected electrode 361C or the detected electrode 362C has reached over the detection surface of the electrostatic capacitance sensor electrode 321C. If the CPU 40 determines that the detection level is not equal to or more than 150 in S106C and that equal to or more than 2.0 seconds have passed in S107C, the CPU 40 determines that there is an abnormality in S105C and notifies the video controller 42 of the abnormality. If the CPU 40 determines that equal to or more than 2.0 seconds have not passed in S107C, the CPU 40 continues the process of S106C.

The CPU 40 determines that there is an ascending flank in S108C and then starts the timer A in S109C. If the CPU 40 determines that the detection level is less than 150 in S110C, the CPU 40 determines that there is a descending flank of the signal of the detection sensor in S112C. The detection level 150 is a so-called descending flank threshold. If the CPU 40 determines that the detection level is not less than 150 in S110C and that equal to or more than 2.0 seconds have passed after the start of the timer in S111C, the CPU 40 determines that there is an abnormality in S105C and notifies the video controller 42 of the abnormality. If the CPU 40 determines that equal to or more than 2.0 seconds have not passed after the start of the timer in S111C, the CPU 40 continues the process of S110C.

If the CPU 40 determines that the detection level is equal to or more than 150 in S113C, the CPU 40 determines that there is an ascending flank of the signal of the detection sensor in S115C and stops the timer A. If the CPU 40 determines that the detection level is not equal to or more than 150 in S113C and that equal to or more than 2.0 seconds have passed after the start of the timer in S114C, the CPU 40 determines that there is an abnormality in S105C and notifies the video controller 42 of the abnormality. If the CPU 40 determines that equal to or more than 2.0 seconds have not passed after the start of the timer in S114C, the CPU 40 continues the process of S113C.

The subsequent process from S116C to S123C is the same as the process from S108C to S115C, except that the timer B replaces the timer A. Therefore, the description will not be repeated. The CPU 40 determines which of the time detected by the timer A and the time detected by the timer B is the time from the arrival of the detected electrode 361C to the detection surface of the electrostatic capacitance sensor electrode 321C to the arrival of the detected electrode 362C to the detection surface of the electrostatic capacitance sensor electrode 321C. Although the reference member 30C and the agitation element 34C are provided on the rotation shaft 29C in the toner container 23C with the phase shifted by 180 degrees, the agitation element 34C rotates while touching the wall in the toner container 23C. Therefore, even if the toner remaining amount in the toner container 23C is relatively small, the time from the arrival of the detected electrode 361C to the detection surface of the electrostatic capacitance sensor electrode 321C to the arrival of the detected electrode 362C to the detection surface of the electrostatic capacitance sensor electrode 321C is over 500 msec.

The CPU 40 compares the value of the timer A with the value of the timer B in S124C. In S125C, the CPU 40 sets the larger timer value as a result of the comparison as a detection time TDET. The CPU 40 determines whether the detection time TDET is greater than 500 msec in S126C. If the CPU 40 determines that the detection time TDET is equal to or less than 500 msec in S126C, the CPU 40 determines that there is an abnormality in S105C and notifies the video controller 42 of the abnormality. If the CPU 40 determines that the detection time TDET is greater than 500 msec in S126C, the CPU 40 checks up the detection time TDET in the table T in S127C. The CPU 40 notifies the video controller 42 of the toner remaining amount corresponding to the checked up value in S128C.

Although the timer A and the timer B are started based on the ascending flank of the signal of the sensor in the present embodiment, the timer A and the timer B may be started based on the descending flank. Although the timer A and the timer B are measured once each to calculate the detection time TDET in the sequence of the present embodiment, the timer A and the timer B may be measured for a plurality times to average the measurements. In this way, the accuracy of the toner remaining amount detection can be improved. Although the reference member 30C and the agitation element 34C make rotational movements in the detection sequence of the toner remaining amount, the toner remaining amount can be detected in the image formation operation if the reference member 30C and the agitation element 34C rotate. The reference member 30C and the agitation element 34C may be rotated for several times before the detection of the toner remaining amount, and the toner remaining amount detection may be started from a state in which the rotations are stable. The values of the descending flank threshold, the ascending flank threshold, and the timers defined here are an example in the present configuration. The values are determined by comprehensively considering the arrangement of the detected electrode 361C and the detected electrode 362C, the rotational speed of the reference member 30C and the agitation element 34C, and the electrostatic capacitance sensor IC33C, and the values are not limited to the values described above. Although an example of arranging the detected electrode 362C on the agitation element 34C has been illustrated in the present embodiment, the same advantageous effect can be obtained by separately arranging the detected electrode 362C from the agitation element 34C.

In this way, the determination is based on the time difference between the arrival of the detected electrode 361C to the detection surface of the electrostatic capacitance sensor electrode 321C and the arrival of the detected electrode 362C to the detection surface of the electrostatic capacitance sensor electrode 321C. As a result, the toner remaining amount can be sequentially detected from when the toner is full until the toner is empty. The electrostatic capacitance changes according to the approach by the detected electrode 361C and the detected electrode 362C. Therefore, the acceleration of the detection time and the image formation operation can be performed at the same time. The curvature of the agitation element 34C is stable according to the toner remaining amount even if the agitation element 34C is rotating at a high speed. Therefore, the toner remaining amount can be sequentially detected.

According to the present embodiment, the remaining amount of the toner can be sequentially detected from when the toner is full until the toner is empty, and the remaining amount of the toner can be accurately detected even if the agitation member is moving at a high speed.

Seventh Embodiment

In the sixth embodiment, the toner remaining amount is detected based on the time difference between the arrival of the detected electrode 361C to the detection surface of the electrostatic capacitance sensor electrode 321C and the arrival of the detected electrode 362C to the detection surface of the electrostatic capacitance sensor electrode 321C. In the present embodiment, the toner remaining amount is detected based on a difference between the detection levels of the electrostatic capacitance (electrostatic capacitance values) based on the detected electrodes 361C and 362C detected by the electrostatic capacitance sensor IC33C.

The configurations of FIGS. 1, 17A to 17C, 18B, and 18C described in the sixth embodiment as well as the circuit diagram of the toner remaining amount detection of FIG. 18A are also applied to the color laser printer of the present embodiment. The same configurations as in the sixth embodiment are designated with the same reference numerals, and the detailed description will not be repeated. The length in the rotation shaft direction, the length in the radial direction, and the flexibility of the reference member 30C and the agitation element 34C are the same as in the sixth embodiment. In the present embodiment, as illustrated in FIGS. 18B and 18C, the electrostatic capacitance sensor electrode 321C is at a lower part of the developing unit in the direction of the gravitational force and is provided at a position about 5 to 20 mm above the bottom of the developing unit.

When the agitation element 34C makes a rotational movement, the agitation element 34C is affected by the resistance of the toner 28C and is transformed backward in the rotation direction. The agitation element 34C makes a rotational movement while being curved. Meanwhile, the reference member 30C is less flexible, and the curvature caused by the toner is small. The reference member 30C is not largely transformed backward in the rotation direction. In this state, the detected electrodes 361C and 362C pass over the detection surface of the electrostatic capacitance sensor electrode 321C. When the detected electrode 361C of the reference member 30C passes over the detection surface of the electrostatic capacitance sensor electrode 321C, the time width of the detection of the electrostatic capacitance by the electrostatic capacitance sensor IC33C is constant regardless of the toner remaining amount. If the toner remaining amount is large as illustrated in FIG. 18B, the agitation element 34C is significantly affected by the resistance of the toner when passing over the detection surface of the electrostatic capacitance sensor electrode 321C. The agitation element 34C is largely curved and passes through a position away from the bottom of the developing unit. Therefore, the area where the detected electrode 362C passes over the detection surface of the electrostatic capacitance sensor electrode 321C is large. More specifically, the detection level detected by the electrostatic capacitance sensor IC33C is large. Meanwhile, as illustrated in FIG. 18C, if the toner remaining amount is small, the resistance of the toner 28C is smaller when the agitation element 34C passes over the detection surface of the electrostatic capacitance sensor electrode 321C, compared to when the toner remaining amount is large. The agitation element 34C passes through a position near the bottom of the developing unit. Therefore, the area where the detected electrode 362C passes over the detection surface of the electrostatic capacitance sensor electrode 321C is smaller than when the toner remaining amount is large. More specifically, the detection level detected by the electrostatic capacitance sensor IC33C is small.

In the present embodiment, the agitation element 34C is affected by the resistance of the toner 28C and is largely curved when the toner remaining amount is 100%. The agitation element 34C makes a rotational movement at about 5 mm from the bottom of the developing unit. In that case, the area where the detected electrode 362C passes over the detection surface of the electrostatic capacitance sensor electrode 321C is maximized. The distance from the bottom of the developing unit decreases with a decrease in the remaining amount, and the area where the detected electrode 362C passes over the detection surface of the electrostatic capacitance sensor electrode 321C is reduced. In this way, the area where the detected electrode 362C passes through the electrostatic capacitance sensor electrode 321C changes according to the toner remaining amount. Meanwhile, the reference member 30C is less flexible. Therefore, the curvature caused by the resistance of the toner is small, and the area where the detected electrode 361C passes over the detection surface of the electrostatic capacitance sensor electrode 321C is constant regardless of the toner remaining amount. The entire surface of the detected electrode 361C passes over the detection surface of the electrostatic capacitance sensor electrode 321C regardless of the toner remaining amount. Therefore, the detected level does not depend on the toner remaining amount. As a result, the difference between the detection level when the detected electrode 361C passes over the detection surface of the electrostatic capacitance sensor electrode 321C and the detection level when the detected electrode 362C passes over the detection surface of the electrostatic capacitance sensor electrode 321C changes according to the toner remaining amount. This principle is used to detect the toner remaining amount.

Toner Remaining Amount Detection Characteristics

Detection characteristics of the toner remaining amount according to the present embodiment will be described with reference to FIGS. 21A to 21C. FIG. 21A illustrates a characteristic graph illustrating the toner remaining amount (%) and the difference between the average detection level of the detected electrode 361C of the reference member 30C detected by the electrostatic capacitance sensor IC33C and the average detection level of the detected electrode 362C of the agitation element 34C. FIG. 21B illustrates waveform data of the detection level when the toner remaining amount is 80%. In the present embodiment, the average values of the detection levels of the detection of the detected electrodes 361C and 362C included in the reference member 30C and the agitation element 34C by the electrostatic capacitance sensor IC33C are calculated, and the difference between the calculated average detection levels is used to determine the toner remaining amount. When the threshold of the detection level for detecting the detected electrodes 361C and 362C is 150, the average value of the detection level based on the detected electrode 361C is calculated to be 207.5, and the average value of the detection level based on the detected electrode 362C is calculated to be 168.0. Therefore, it can be recognized that the difference between the average detection level of the reference member 30C and the average detection level of the agitation element 34C is 39.5. FIG. 21C illustrates a table L indicating a relationship between the difference in the average detection level and the toner remaining amount (%). The toner remaining amount between numerical values in the table is obtained by linear interpolation of known toner remaining amounts. The calculated difference in the average detection level is a value in the present embodiment. Therefore, the calculated difference in the average detection level changes if the conditions change. The same applies to the numerical values in the table for determining the toner remaining amount. In the present embodiment, the detection level (8-bit level data) of the electrostatic capacitance sensor IC33C is displayed in decimal (dec) in the description.

Flow Chart of Toner Remaining Amount Detection

Figures 22, 22A:
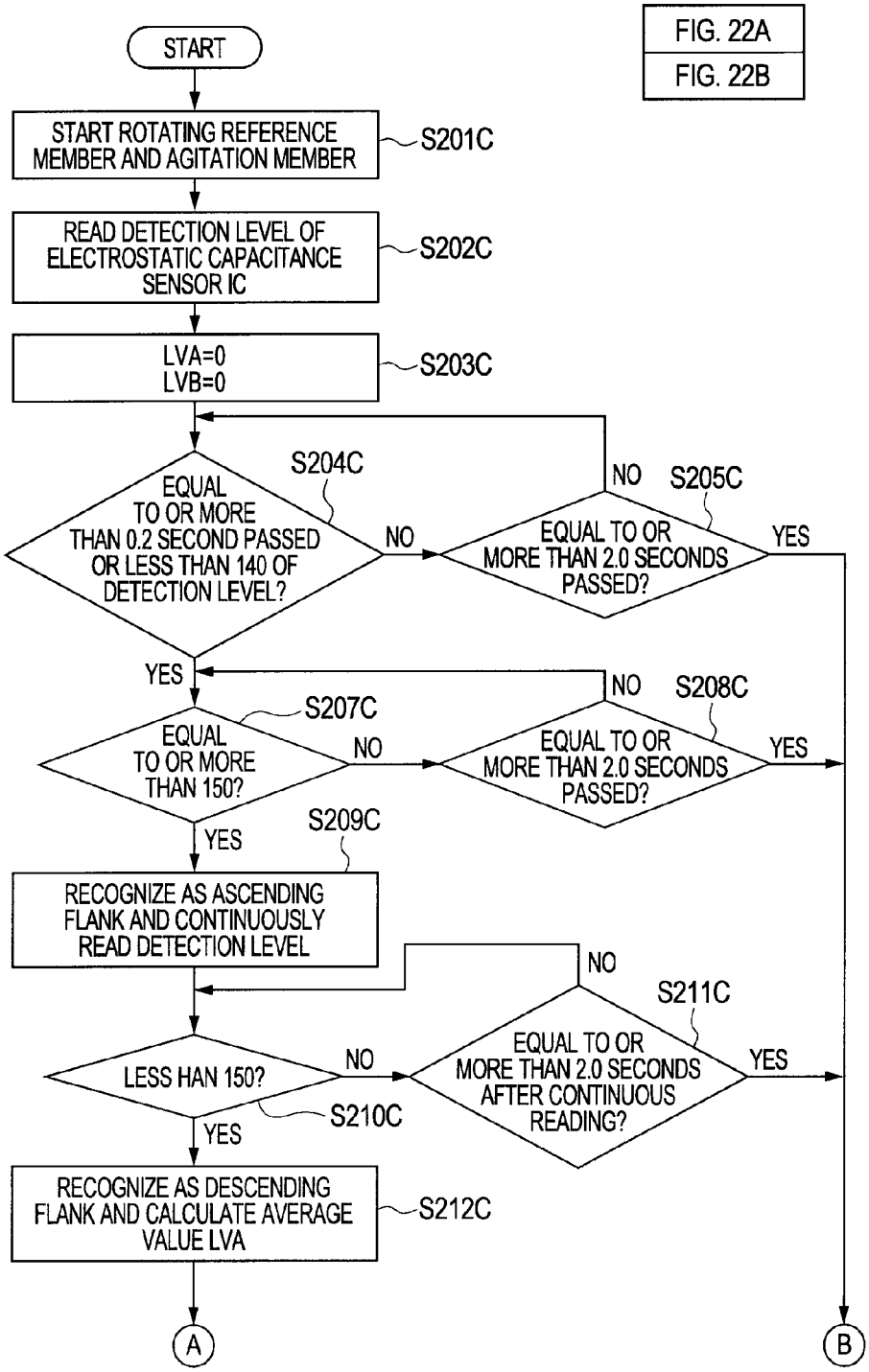
FIG. 22 is comprised of FIGS. 22A and 22B showing flow charts of the toner remaining amount detection of the seventh embodiment.
Figure 22B:
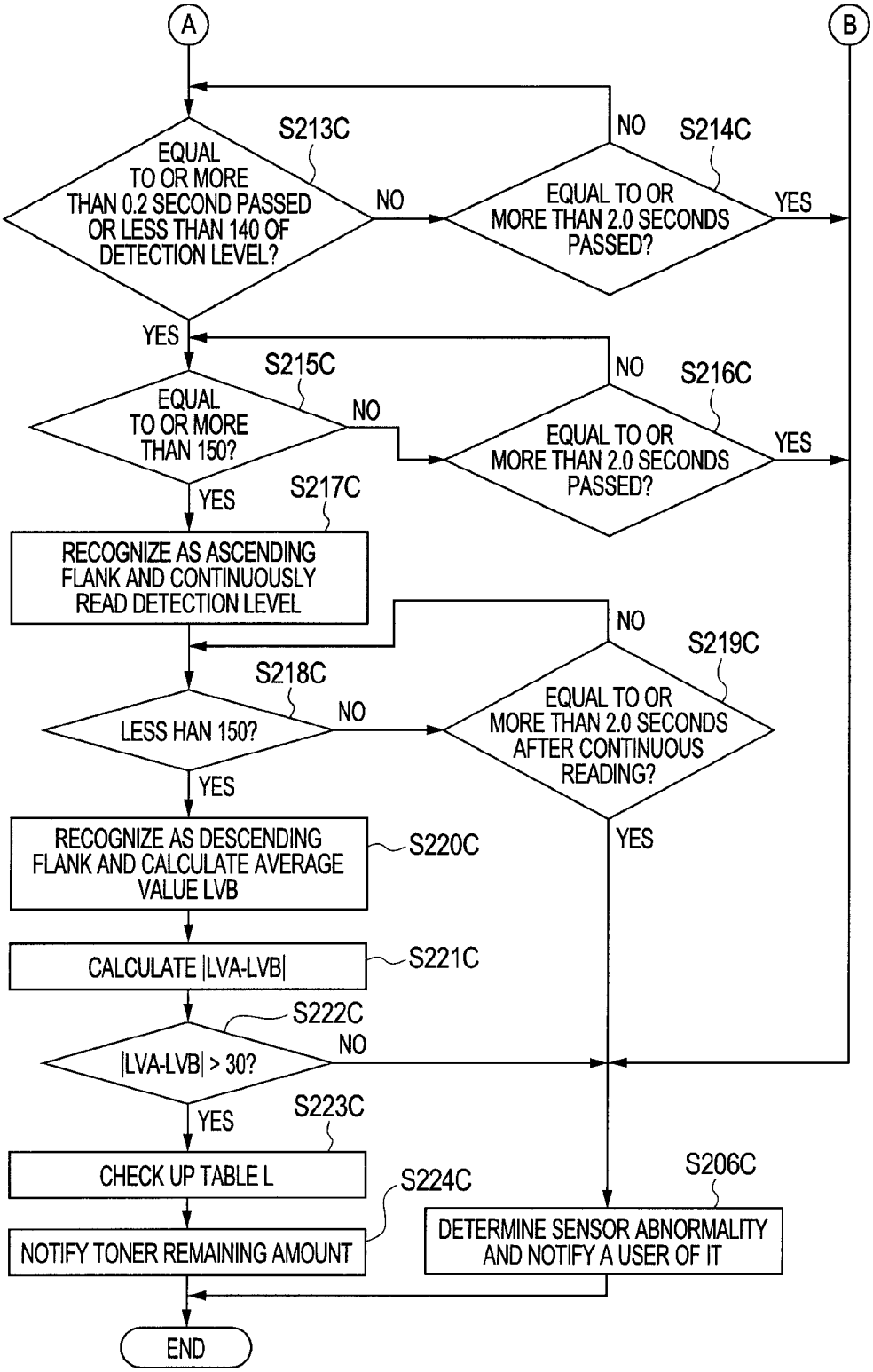

A sequence of detecting the toner remaining amount according to the present embodiment will be described with reference to flow charts of FIGS. 22A and 22B. An average value LVA of the detection level is obtained in the following process of S204C to S212C, and an average value LVB of the next detection level is obtained in the process from S213C to S220C.

Figures 20, 20A:
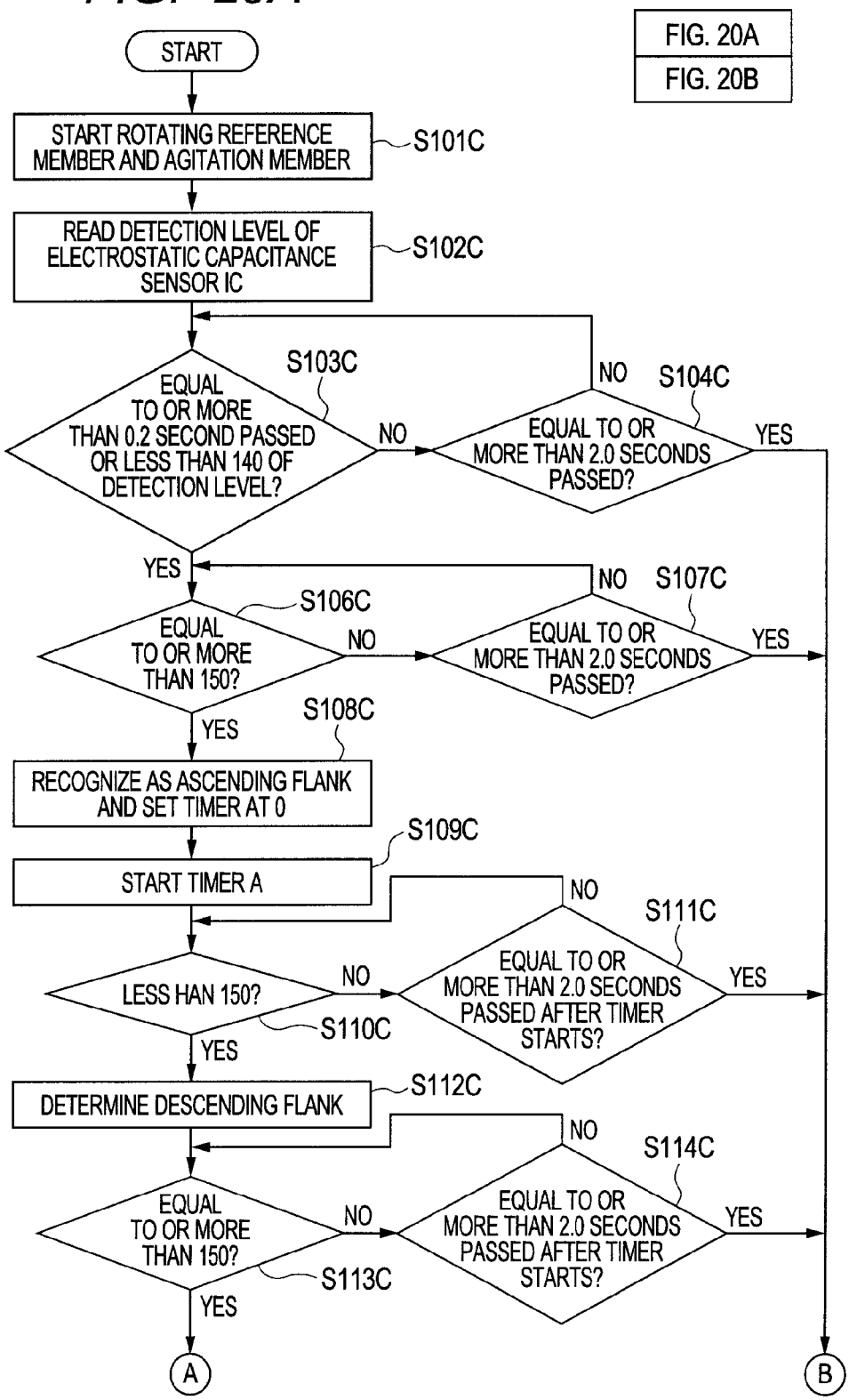
FIG. 20 is comprised of FIGS. 20A and 20B showing flow charts of the toner remaining amount detection of the sixth embodiment.
Figure 20B:
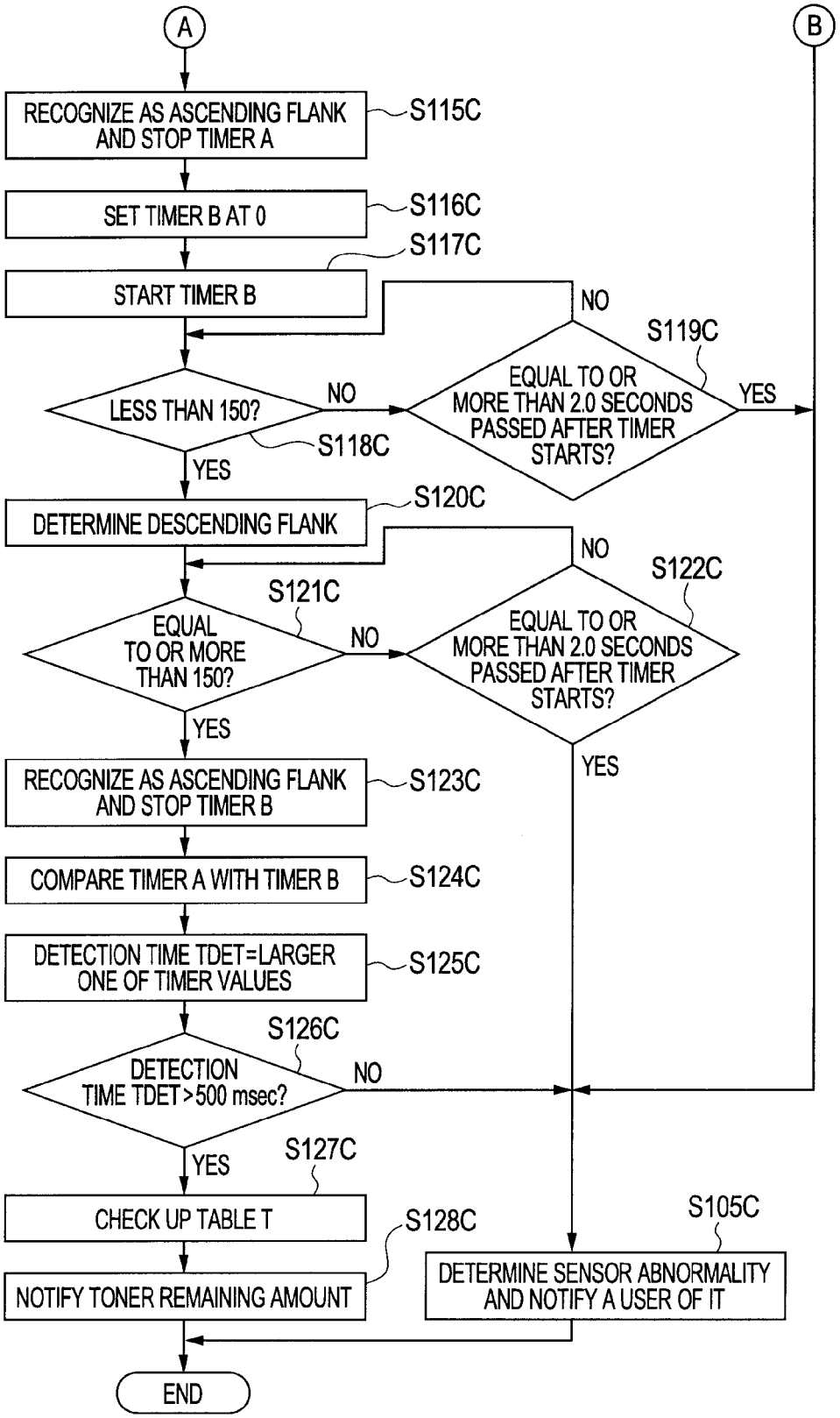

The process of S201C and S202C is the same as the process of S101C and S102C of the flow charts of FIGS. 20A and 20B and will not be described. In S203C, the CPU 40 sets the average values LVA and LVB to 0. If the CPU 40 determines that the detection level is less than 140 for equal to or more than 0.2 second in S204C, the CPU 40 determines that the level is in an initial state of the position in which the detected electrodes 361C and 362C are not over the detection surface of the electrostatic capacitance sensor electrode 321C, and the CPU 40 proceeds to a process of S207C. If the CPU 40 determines that the detection level is not less than 140 for equal to or more than the detection equal to or more than 0.2 second in S204C, and if equal to or more than 2.0 seconds have passed in S205C, the CPU 40 determines that there is an abnormality in S206C and notifies the video controller 42 of the abnormality. If the CPU 40 determines that equal to or more than 2.0 have not passed in S205C, the CPU 40 continues the process of S204C. If the CPU 40 determines that the detection level is equal to or more than 150 in S207C, the CPU 40 determines that there is an ascending flank of the signal of the sensor in S209C and performs continuous reading of the detection level. The detection level 150 is a so-called ascending flank threshold. If the CPU 40 determines that the detection level is not equal to or more than 150 in S207C and determines that equal to or more than 2.0 seconds have passed in S208C, the CPU 40 determines that there is an abnormality in S206C and notifies the video controller 42 of the abnormality. If the CPU 40 determines that equal to or more than 2.0 seconds have not passed in S208C, the CPU 40 continues the process of S207C.

If the CPU 40 determines that the detection level is less than 150 in S210C, the CPU 40 determines that there is a descending flank of the signal of the sensor in S212C and calculates the average value LVA of the continuously read values. The detection level 150 is a so-called descending flank threshold. If the CPU 40 determines that the detection level is not less than 150 in S210C and determines that equal to or more than 2.0 seconds have passed after the start of the continuous reading in S211C, the CPU 40 determines that there is an abnormality in S206C and notifies the video controller 42 of the abnormality. If the CPU 40 determines that equal to or more than 2.0 seconds have not passed after the start of the continuous reading in S211C, the CPU 40 continues the process of S210C.

The following process from S213C to S220C is the same as the process from S204C to S212C, except that the average value LVB replaces the average value LVA. Therefore, the description will not be repeated. In all toner remaining amounts, the detection level of the detected electrode 361C of the reference member 30C is higher than the detection level of the detected electrode 362C of the agitation element 34C. Therefore, the CPU 40 calculates an absolute value of LVA-LVB. The CPU 40 determines in S222C whether the absolute value calculated in S221C is greater than 30. If the CPU 40 determines that the absolute value calculated in S221C is equal to or less than 30, the CPU 40 determines that there is an abnormality in S206C and notifies the video controller 42 of the abnormality. If the CPU 40 determines that the absolute value calculated in S222C is greater than 30C, the CPU 40 checks up the absolute value in the table L in S223C. The CPU 40 notifies the video controller 42 of the toner remaining amount corresponding to the checked up value in S224C.

Although the average value LVA and the average value LVB are measured once each to calculate the absolute value of LVA-LVB in the sequence of the present embodiment, the accuracy of the toner remaining amount detection can be improved by measuring the average value LVA and the average value LVB for a plurality of times to average the values. Although the reference member 30C and the agitation element 34C make rotational movements in the detection sequence of the toner remaining amount in the present embodiment, the toner remaining amount can also be detected even if the reference member 30C and the agitation element 34C rotate in the image formation operation. The reference member 30C and the agitation element 34C may be rotated for several times before the detection of the toner remaining amount, and the toner remaining amount detection may be started from a state in which the rotations of the reference member 30C and the agitation element 34C are stable. The descending flank threshold, the ascending flank threshold, the average value LVA, and the average value LVB defined here are an example. The values are determined by comprehensively considering the arrangement of the detected electrode 361C and the detected electrode 362C as well as the rotational speed of the reference member 30C. Therefore, the values are not limited to these. Although an example of arranging the detected electrode 362C on the agitation element 34C has been illustrated in the present embodiment, the same advantageous effect can be obtained by separately arranging a detection Mylar and the agitation element 34C.

In this way, the toner remaining amount is determined based on the difference in the electrostatic capacitance between the detected electrodes 361C and 362C and the electrostatic capacitance sensor electrode 321C included in the reference member 30C and the agitation element 34C, respectively. As a result, the toner remaining amount can be sequentially detected form when the toner is full until the toner is empty. The electrostatic capacitance changes according to the approach by the reference member 30C and the agitation element 34C. Therefore, the reduction in the detection time and the image formation operation can be performed at the same time. The curvatures of the reference member 30C and the agitation element 34C are stable according to the toner remaining amount even in high speed rotations. Therefore, the toner remaining amount can be sequentially detected.

According to the present embodiment, the remaining amount of the toner can be sequentially detected from when the toner is full until the toner is empty, and the remaining amount of the toner can be accurately detected even if the agitation member is moving at a high speed.

Eighth Embodiment

Figure 23:
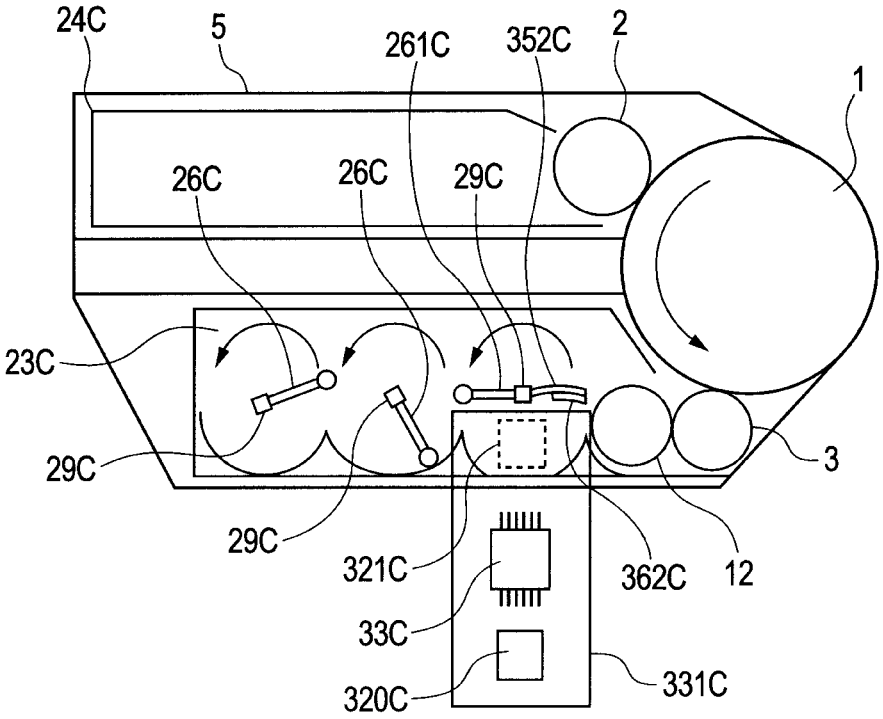
FIG. 23 is a cross-sectional view of the developing unit and the electrostatic capacitance sensor of an eighth embodiment.

In the sixth and second embodiments, the reference member 30C is flexible and is bent by the resistance of the toner 28C. In the present embodiment, a highly rigid agitation bar 261C is used in place of the reference member 30C. The process cartridge according to the present embodiment will be described with reference to FIG. 23C. FIG. 23C is a cross-sectional view of the process cartridge and the electrostatic capacitance sensor board 331C according to the present embodiment. The toners 28C (not illustrated) corresponding to the colors are stored in the toner container 23C. An agitation bar 26 that supplies the toner 28C to the toner supply roller 12 is installed. The agitation bar 26 rotates around the rotation shaft 29C and agitates the toner 28C. The agitation bar 261C and a detection member 352C for detecting the toner remaining amount are installed on the rotation shaft 29C closest to the toner supply roller 12. The agitation bar 261C is highly rigid and rotates at a constant rotational speed without being affected by the resistance of the toner 28C. The detection member 352C is provided with the phase shifted by 180 degrees from the agitation bar 261C and is flexible. The agitation bar 261C is formed by a conductive member. The conductive detected electrode 362C is installed near the leading edge in the radial direction (direction orthogonal to the rotation shaft 29C) of the detection member 352C.

The electrostatic capacitance sensor board 331C including the electrostatic capacitance sensor IC33C, the electrostatic capacitance sensor electrode 321C, and the reference electrode 320C that detect the toner remaining amount in the toner container 23C is installed near the outer wall of the developing unit near the agitation bar 261C and the detection member 352C. The electrostatic capacitance sensor electrode 321C approaches the exterior of the toner container 23C when the process cartridge 5 is mounted on the main body 101. In this state, the electrostatic capacitance sensor IC33C detects the electrostatic capacitance generated by the conductive agitation bar 261C or the detected electrode 362C provided in the developing unit. The circuit diagram of the toner remaining amount detection according to the present embodiment is the same as in FIG. 18A described in the sixth and second embodiments, and the detailed description will not be repeated.

The flow chart of the toner remaining amount detection and the detection characteristics are the same as in the sixth and second embodiments. The agitation bar 261C is highly rigid and constantly rotates without being affected by the resistance of the toner 28C. Therefore, the time detected by the electrostatic capacitance sensor IC33C and the detection level are always constant. As a result, the toner remaining amount can be more accurately detected by calculating the difference between the times detected by the agitation bar 261C and the detection member 352C or the difference between the detection levels.

According to the present embodiment, the remaining amount of the toner can be sequentially detected from when the toner is full until the toner is empty, and the remaining amount of the toner can be accurately detected even if the agitation member is moving at a high speed.

Other Embodiment

It is possible to combine the configuration in which the electrostatic capacitance sensor electrode is provided on the bottom of the developing unit, described in fifth embodiment (FIGS. 16A to 16C), and the configuration in which the electrostatic capacitance sensor electrode is provided on the sides of the developing unit, described in the other embodiments. By the combinations of these configurations, even if the amounts of toner cause unevenness between the end and center portions in the developing unit, the condition of toner in the developing unit is determined based on the detection result of both sensors provided on the bottom and the side of the developing unit, so that the remaining amount of toner can be detected precisely. That is, in the case where the difference between the outputs of sensors on the bottom and side of the developing unit is larger than a predetermined value, it is effective to detect the amount of toner by sensors on the bottom and side of the developing unit after performing reagitation during a predetermined period because there is a possibility of unevenness of toner amount in the developing unit. The predetermined value can be determined by the degree of unevenness in the developing unit. For example, a threshold value (an electrostatic capacitance value) is determined by tests as a predetermined value that is difficult to detect the remaining amount of toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-098088, filed Apr. 26, 2011, Japanese Patent Application No. 2011-107370, filed May 12, 2011, and Japanese Patent Application No. 2011-127421, filed Jun. 7, 2011 which are hereby incorporated by reference herein in their entirety.

The invention claimed is:

1. An image forming apparatus comprising:

a developing unit that contains developer and that is detachable;

a member including a first electrode, said member performing a rotation around a rotation shaft in the developing unit;

a second electrode provided on an outer side of the developing unit, wherein said member bends by the rotation;

an output unit that detects an electrostatic capacitance between the first electrode and the second electrode and that outputs data related to the detected electrostatic capacitance; and a determination unit that determines an amount of the developer in the developing unit based on the data output from the output unit, wherein the determination unit determines the amount of the developer in the developing unit based on an average value of the data during a time in which the data output from the output unit is equal to or more than a predetermined value.

2. An image forming apparatus according to claim 1, wherein the first electrode is provided on an edge on a side of a wall of the developing unit in an axial direction of the member, and near a leading edge in a circumferential direction of the member.

3. An image forming apparatus according to claim 1, wherein the first electrode has a length from near the rotation shaft of the member to near a leading edge in a circumferential direction, and a predetermined width.

4. An image forming apparatus comprising a developing unit that contains developer and that is detachable, the image forming apparatus comprising:

a rotation member that comprises a first electrode and that moves around a rotation shaft in the developing unit, the rotation member being provided on the rotation shaft having flexibility such that the rotation shaft is deformed by resistance of the developer;

a second electrode that is provided at a position where the first electrode is not affected by the resistance of the developer even if the developer is full and that is provided near an outer surface of the developing unit;

a third electrode that is provided at a position where the first electrode is affected by the resistance of the developer even if an amount of the developer is smaller than when the developer is full and that is provided near the outer surface of the developing unit;

a detection unit that detects an electrostatic capacitance between the first electrode and the second electrode or between the first electrode and the third electrode;

a measurement unit that measures a first time at which the detection unit has detected the electrostatic capacitance between the first electrode and the second electrode and a second time at which the detection unit has detected the electrostatic capacitance between the first electrode and the third electrode; and a determination unit that determines an amount of the developer based on a time difference between the first time and the second time measured by the measurement unit.

5. An image forming apparatus according to claim 4, wherein the first electrode is provided on a leading edge section of the rotation member in a radial direction around the rotation shaft and provided parallel to a side that is a wall of the developing unit perpendicular to the rotation shaft, and the second electrode and the third electrode are provided near the side.

6. An image forming apparatus according to claim 4, wherein the first electrode is provided on a surface of a leading edge section of the rotation member in a radial direction around the rotation shaft, and the second electrode and the third electrode are provided in a circumferential direction of the rotation of the first electrode.

7. An image forming apparatus according to claim 4, wherein the rotation member performs an agitating operation of the developer.

8. An image forming apparatus according to claim 4, wherein the determination unit determines whether the detection unit is abnormal based on a result of the detection by the detection unit.

* * * * *